US009656136B2

(12) United States Patent
Van Alen et al.

(10) Patent No.: US 9,656,136 B2
(45) Date of Patent: May 23, 2017

(54) GAME STICK AND GAME UTILIZING THE SAME

(71) Applicant: PlusOne Sports, LLC, Ipswich, MA (US)

(72) Inventors: Alex Van Alen, Ipswich, MA (US); Douglas G. Sabin, Marblehead, MA (US)

(73) Assignee: PlusOne Sports LLC, Ipswich, MA (US)

( * ) Notice: Subject to any disclaimer, the term of this patent is extended or adjusted under 35 U.S.C. 154(b) by 0 days.

(21) Appl. No.: 14/259,855

(22) Filed: Apr. 23, 2014

(65) Prior Publication Data

US 2015/0007803 A1 Jan. 8, 2015

Related U.S. Application Data

(63) Continuation-in-part of application No. 14/170,584, filed on Feb. 1, 2014.

(Continued)

(51) Int. Cl.
*A63B 59/00* (2015.01)
*A63B 59/02* (2006.01)

(Continued)

(52) U.S. Cl.
CPC ..... *A63B 59/02* (2013.01); *A63B 59/20* (2015.10); *A63B 53/007* (2013.01)

(58) Field of Classification Search
CPC ..... A63B 59/02; A63B 59/0088; A63B 59/00; A63B 65/12; A63B 65/122; A63B 67/002;

(Continued)

(56) References Cited

U.S. PATENT DOCUMENTS 1,536,616 A * 5/1925 Manning ..... 473/331
1,585,446 A * 5/1926 Warwick ..... 124/5

(Continued)

FOREIGN PATENT DOCUMENTS

DE 7608267 U1 3/1976
DE 2010017079 A1 12/2011

(Continued)

OTHER PUBLICATIONS

[No Author Listed] Hyper Dog Doggie Driver. EntirelyPets.com product description sheet Accessed online Jun. 17, 2013 via http://entirelypets.com/doggiedriver.html?mr:trackingCode=508C8 . . . 2 pages.

(Continued)

*Primary Examiner* — Alvin Hunter
*Assistant Examiner* — Amir Klayman
(74) *Attorney, Agent, or Firm* — Fish & Richardson P.C.

(57) ABSTRACT

A game stick and game are disclosed. The game stick includes a shaft with a head at one end. A channel wide enough for a game ball is defined in the head. The ball is placed in the channel and when the game stick is swung, the ball rides along the channel and is released therefrom to fly through the air. The head may be adjustable to affect the way in which the ball is thrown. The game is similar to golf except that instead of hitting the ball, the ball is thrown toward a target location at the end of a fairway. When the target location is reached, the game stick may be used as a putter to push or putt the ball to sink it into a sunken cup in the ground.

16 Claims, 17 Drawing Sheets

Related U.S. Application Data

(60) Provisional application No. 61/842,211, filed on Jul. 2, 2013.

(51) Int. Cl.
*A63B 59/20* (2015.01)
*A63B 53/00* (2015.01)

(58) Field of Classification Search
CPC . A63B 67/02; A63B 2243/0029; A63B 57/00; A63B 69/3623; A63B 15/00; A63B 53/00
USPC ..... 124/5; 473/131; 273/317.2
See application file for complete search history.

(56) References Cited

U.S. PATENT DOCUMENTS

| | | | | |
|---|---|---|---|---|
| 1,877,820 | A * | 9/1932 | Costello | 473/235 |
| 1,905,932 | A | 4/1933 | Foster | |
| 2,029,790 | A | 2/1936 | Bernhard | |
| 2,094,766 | A * | 10/1937 | Costello | 473/138 |
| D110,863 | S | 8/1938 | Hayes et al. | |
| 2,179,034 | A | 11/1939 | Duncan, Jr. | |
| D183,084 | S | 6/1958 | Carlson | |
| 2,856,190 | A | 10/1958 | Quattrin | |
| 3,170,688 | A | 2/1965 | Porter | |
| 3,366,389 | A | 1/1968 | Murray | |
| 3,392,978 | A | 7/1968 | Wiest | |
| 3,589,349 | A | 6/1971 | Parker | |
| D223,269 | S | 4/1972 | Collver | |
| 3,970,307 | A | 7/1976 | Breglia | |
| 3,997,169 | A * | 12/1976 | Bergstrom | 473/286 |
| D244,306 | S | 5/1977 | Bisch | |
| 4,045,026 | A | 8/1977 | Gillespie et al. | |
| 4,085,936 | A | 4/1978 | Patterson | |
| 4,111,422 | A | 9/1978 | Burcenski | |
| 4,313,605 | A | 2/1982 | Stokes et al. | |
| D263,248 | S | 3/1982 | Brine, Jr. | |
| 4,364,371 | A | 12/1982 | Woolard | |
| 4,527,801 | A | 7/1985 | Lambert | |
| 4,548,413 | A | 10/1985 | David | |
| 4,673,186 | A | 6/1987 | Walker | |
| 4,794,905 | A | 1/1989 | Woolard | |
| 5,088,469 | A | 2/1992 | Hargrave | |
| D325,612 | S | 4/1992 | Longo | |
| 5,129,650 | A | 7/1992 | Hayman | |
| 5,228,689 | A | 7/1993 | Donofrio, Sr. | |
| 5,297,794 | A | 3/1994 | Lu | |
| D350,999 | S | 9/1994 | Chen | |
| 5,392,755 | A | 2/1995 | Sutton | |
| D363,098 | S | 10/1995 | Chen | |
| D363,960 | S | 11/1995 | Choi | |
| D368,291 | S | 3/1996 | Sullivan et al. | |
| 5,522,372 | A | 6/1996 | Gerstikov | |
| 5,908,360 | A | 6/1999 | Guillont | |
| 5,935,016 | A | 8/1999 | Antonious | |
| D424,640 | S | 5/2000 | Oblack | |
| 6,066,056 | A * | 5/2000 | Morrow | 473/513 |
| 6,076,829 | A | 6/2000 | Oblack | |
| D428,085 | S | 7/2000 | Kirch | |
| 6,083,128 | A | 7/2000 | Young et al. | |
| 6,435,975 | B2 | 8/2002 | Middleton | |
| 6,634,955 | B2 | 10/2003 | Middleton | |
| D484,938 | S | 1/2004 | Tu | |
| 6,837,800 | B2 | 1/2005 | Rollinson et al. | |
| 6,878,072 | B1 | 4/2005 | Henry | |
| D507,027 | S | 7/2005 | Hale | |
| 7,032,583 | B1 | 4/2006 | Hall | |
| D525,326 | S | 7/2006 | Green | |
| D525,670 | S | 7/2006 | Green | |
| 7,121,966 | B2 * | 10/2006 | Fitzmaurice | 473/559 |
| 7,128,556 | B2 | 10/2006 | Wessells et al. | |
| 7,172,513 | B1 | 2/2007 | Rinker | |
| D539,859 | S | 4/2007 | Eldridge | |
| D554,717 | S | 11/2007 | McKinnell | |
| 7,357,739 | B2 | 4/2008 | Montano et al. | |
| 7,520,818 | B2 | 4/2009 | Winchester | |
| D603,917 | S | 11/2009 | Riikonen | |
| 7,648,433 | B1 | 1/2010 | Huqueriza | |
| 7,677,994 | B2 | 3/2010 | Matsumoto et al. | |
| 7,686,001 | B2 | 3/2010 | Fitt | |
| 7,686,702 | B2 | 3/2010 | Hubley | |
| 7,900,617 | B1 | 3/2011 | Kersh | |
| 7,927,224 | B1 | 4/2011 | Ferguson et al. | |
| D637,248 | S | 5/2011 | Levin et al. | |
| 7,935,009 | B2 | 5/2011 | Mullin | |
| D640,338 | S | 6/2011 | Oblack | |
| 7,988,567 | B2 | 8/2011 | Kim et al. | |
| 8,015,968 | B2 | 9/2011 | Christ | |
| 8,028,684 | B1 | 10/2011 | Weissmann et al. | |
| D655,359 | S | 3/2012 | Thorogood | |
| 8,246,480 | B2 | 8/2012 | Parks et al. | |
| D666,686 | S | 9/2012 | Burger | |
| D674,851 | S | 1/2013 | Osborne et al. | |
| 8,353,780 | B2 | 1/2013 | Hatton et al. | |
| 8,387,601 | B1 | 3/2013 | Christensen | |
| 8,418,681 | B2 | 4/2013 | Levin et al. | |
| 8,454,452 | B2 | 6/2013 | Wallans | |
| 8,517,003 | B2 | 8/2013 | Fisher | |
| 8,539,939 | B2 | 9/2013 | Minneman et al. | |
| 8,960,172 | B2 * | 2/2015 | Ivanic | A63B 59/02 124/5 |
| 9,149,695 | B2 | 10/2015 | Evans | |
| 2002/0160851 | A1 * | 10/2002 | Liao | 473/300 |
| 2003/0045200 | A1 | 3/2003 | Tarng et al. | |
| 2005/0070367 | A1 | 3/2005 | Pickering et al. | |
| 2006/0229136 | A1 | 10/2006 | Presley | |
| 2009/0036239 | A1 | 2/2009 | Dickie et al. | |
| 2009/0075765 | A1 * | 3/2009 | Eldridge | 473/513 |
| 2011/0100345 | A1 | 5/2011 | Minneman et al. | |
| 2011/0230275 | A1 | 9/2011 | Hicks | |
| 2011/0275454 | A1 | 11/2011 | Stites et al. | |
| 2012/0048251 | A1 | 3/2012 | Oblack et al. | |
| 2012/0142446 | A1 | 6/2012 | Evans et al. | |
| 2012/0227721 | A1 | 9/2012 | Geller | |
| 2012/0231896 | A1 | 9/2012 | Seluga et al. | |
| 2012/0312286 | A1 | 12/2012 | Kilian | |
| 2013/0085010 | A1 | 4/2013 | Beach et al. | |
| 2013/0130820 | A1 | 5/2013 | Parks | |
| 2013/0167818 | A1 | 7/2013 | Ivanic et al. | |
| 2013/0186381 | A1 | 7/2013 | Hansen | |
| 2013/0319386 | A1 | 12/2013 | Minneman et al. | |
| 2014/0041188 | A1 | 2/2014 | Radocy | |
| 2014/0144417 | A1 * | 5/2014 | Evans | 124/5 |

FOREIGN PATENT DOCUMENTS

| | | | |
|---|---|---|---|
| FR | 2633190 | A | 12/1989 |
| GB | 191207813 | | 0/1912 |
| GB | 2385537 | A1 | 8/2003 |
| KR | 2010-0090332 | A | 8/2010 |
| WO | WO 2006/108274 | | 10/2006 |

OTHER PUBLICATIONS

[No Author Listed] Golf Club (All in One). DIYTrade.com product description sheet. Accessed online Jun. 17, 2013 via http://www.diytrade.com/china/pd/2617657/Golf_Club_All_In_One.html 4 pages.

[No Author Listed] The Lacrosse Lover's Dog Ball Thrower. BigAppleHerp.com product description sheet. Accessed online Jun. 26, 2013 via www.bigappleherdp.com http://www.bigappleherp.comiThe-Lacrosse-Lovers-Dog-Ball-Thrower.

International Search Report and Written Opinion mailed Feb. 4, 2015 in connection with Application No. PCT/US2014/049384.

No Author Listed, YLS Grip-N-Rip Lax-Golf Tournament. Ylslacrosse.com tournament description. Accessed online Dec. 16, 2014 via http://www.ylslacrosse.com/Default.aspx?tabid=535306.

IDS Appendix, dated Nov. 4, 2015.

Replacement drawings for U.S. Appl. No. 13/779,676, having a Mail Room Date of Aug. 14, 2015.

Screenshot of USPTO PAIR "Continuity Data" tab for U.S. Appl. No. 13/779,676.

(56) References Cited

OTHER PUBLICATIONS

International Preliminary Examination Report for PCT Appl. No. PCT/US2014/049384, dated Aug. 2, 2016.

* cited by examiner

GAME STICK AND GAME UTILIZING THE SAME

CROSS-REFERENCE TO RELATED APPLICATIONS

This application claims the benefit of U.S. Provisional Application Ser. No. 61/842,211 filed Jul. 2, 2013, and U.S. Non-Provisional application Ser. No. 14/170,584 filed Feb. 1, 2014, the entire specifications of which are incorporated herein by reference.

FIELD OF THE INVENTION

The present invention relates to sports games and to an implement used to play a sports game. In particular, the present invention relates to a game involving a game stick or club and a ball.

BACKGROUND OF THE INVENTION

As is well known in the art, golf is a game that is played on a golf course which includes nine or eighteen holes. Each hole includes a tee-off location, a fairway and a green, with the tee-off location being situated some distance from the green. A cup (a depression in the ground) is located somewhere on the green and is marked by a flag so that the golfer has a visual aid at which to aim during play. The golfer positions his or her ball at the tee-off location on a particular hole and strikes the ball with the head of one of a group of clubs to move the ball through the air to some distance down the fairway. The fairway is of a sufficient length to require the golfer to strike the ball one or more times to move the ball from the tee-off location to the remote green. Once at the green, the golfer selects a putter (a specially designed club) to strike the ball so that it rolls across the surface of the green toward the cup and drops into the same. Depending on the skill of the golfer, the putter may need to be used more than once to sink the ball in the cup. Each strike of the ball with a club or with a putter is counted as a single stroke. Each hole on the golf course is rated so that the golfer will know a desired number of strokes to play for that particular hole. Scoring is based on how many strokes it takes the golfer to get the golf ball from the tee-off location to the point he or she sinks the ball in the cup. Thus, a hole is a par-three (three strokes), par-four (four strokes) or par-five (five strokes). The fairway will typically include one or more obstacles such as sand-traps or water hazards to increase the difficulty of play. Penalties can be accrued on a hole if a golfer makes a miss-step during play.

Golfers are required to play in accordance with a standard set of procedures and rules. The rules are dependent upon the country in which the game is played with the majority of the world playing in accordance with the rules set out by The Royal and Ancient Golf Club of St. Andrews in Scotland. In the United States golfers have to adhere to rules administered by the United States Golf Association (USGA).

While there are a vast number of golfers in the world it has become apparent over recent years that fewer younger people are taking part in this well-loved sport. The reasons for this are not entirely clear but several studies have suggested that the game is too slow for the younger generation, requires too much time, skill, and effort, and is too costly from the point of view of equipment needed, lessons that have to be taken, as well as for the play of a single round of the game. Because of this situation, golf courses, particularly at the local level, are struggling to stay afloat financially.

In addition to this situation, there is growing evidence that younger people are not as active as they should or could be and this lack of activity is posing a serious risk to their long-term health.

There is therefore a need in the art for a game that encourages younger people to become more active, is fun, quick to learn and relatively inexpensive to play.

SUMMARY OF THE INVENTION

A game and a game stick for playing this new game are disclosed. The game is a new athletic sport that can be played on a course which includes one or more 'holes'. Preferably, the course is outdoors and each hole includes a starting location, a remote target location and a fairway between the start and target locations. The course could be a grassy course or a sandy course (such as on a beach), or could even be an indoor course. Existing golf courses may act as suitable courses for playing the new game but it is contemplated that dedicated courses for the game could also be utilized. It is still further contemplated that players could set up their own course at any desired location, such as a beach for example, and play a "pick-up" version of the game that will be described further herein.

A specially designed game stick is used for play and this game stick includes a shaft with a grip at one end and a head at the other end. The game ball may be played in at least two different ways using this game stick. In a first aspect, the invention may provide a game stick having a shaft with a first end and a second end; a head provided at the second end of the shaft; a channel defined in the head and configured to receive the game ball therein and from which channel the game ball is thrown during play. The game stick also may include a striking or pushing surface provided on the stick for pushing or putting the game ball when the ball is resting on a ground surface during play.

The game ball may be a specially designed ball for a particular game stick and game, or the game ball can be a golf ball and the game stick configured consistent with golf ball dimensions. In embodiments, the channel can be configured to be only slightly larger than the ball which is to be used for the game, for example only 0.5 mm to 10 mm bigger than the diameter of the ball at the mid-point of the ball when the ball is in the channel. So, if a regular golf ball is used, the channel will be sized at the mid-point of a golf ball as it travels along the channel to be marginally wider than the diameter of a regular golf ball (which in the Unites States is 42.67 mm and in Britain is 41.15 mm). In embodiments where a golf ball is used, the width of the channel is less than 50 mm, 49 mm, 48 mm, 47 mm, 46 mm, 45 mm, 44 mm, 43.5 mm, 43 mm, 42.5 mm or even 42 mm. In embodiments, the channel size can be less than 120%, 115%, 110%, 108%, 106%, 105%, or even 104% wider than the width of the ball at the mid-point of the ball when the ball is in the channel. In embodiments where a U.S. golf ball is used, the width of the channel can be between 43.17 and 46.67 (inclusive), 43.67 and 45 mm (inclusive), or about 44 mm.

During play on a course like a golf course, the player will place the ball in the channel of the head and throw the ball a distance down a fairway of a particular hole on the course. Throwing is accomplished by swinging the game stick through the air such as, for example, when throwing with a lacrosse stick, and then finishing the swing in such a way that the ball flies out of an opening at one end of the channel. The ball is retained in the head by centrifugal force during the swing and is propelled in part by that same force as it exits the channel. The game stick may be swung in pretty much any manner so that the player is able to throw the ball therefrom in a variety of different ways including but not limited to an overhand throw, underhand throw, forehand throw, backhand throw, a lob or any other manner that suits the player. The game stick may also be utilized to put a spin on the ball. The player may take a running start when throwing the ball.

The game begins at a starting location. If the course being utilized is a golf course, the starting location may be an area on a particular hole where traditional golfers tee off. Alternatively, the starting location may be an area that is specially designated and set up for players of this new sport and may be marked in any suitable fashion.

A player swings his or her game stick through the air to throw the ball down the fairway of the course and toward a target location. This may be with a running start, where the ball is released prior to crossing a start position. The player will then move to the position on the fairway where the ball landed after the throw, pick up the ball by hand (or using the stick) and place the ball in the channel of the game stick (or pick up the ball with the game stick) and then make a second throw of the ball toward the target location. One or more throws may be required to move the ball from the starting location to the target location. When the ball reaches the target location, such as a green surrounding a flagged cup of a golf course, the player will change their grip on the game stick from a throwing grip to a putting/pushing grip. The player will then use the dedicated striking surface on the game stick to push or putt the ball in a direction toward the sunken cup in order to try and sink the ball in the cup. One or more putts or pushes may prove to be necessary to accomplish this play. Alternatively, the player could use a conventional putter when the player reaches the green.

The head of the game stick may further include a recessed region on one of the side walls, rear wall or front wall thereof. The ball may be placed in this recess for throwing or chipping the ball shorter distances. Still further, the head may include a surface on one or both side walls, end wall or in some instances the front wall for hitting the ball. In this type of play, the ball may be tossed in the air and then struck with this hitting or striking surface.

Still further, the head may be adjustable relative to the shaft so that the player is able to make changes to the angle at which the channel extends relative to the shaft. This enables the player to change an arc through which the ball is thrown and also to affect the spin on the ball as desired. Alternatively, a player may have more than one game sticks, each with a different angle at which the channel extends relative to the shaft.

Still further, the head has a length which is measured from a front end to a back end thereof; and the channel generally extends along the majority of this length. It is contemplated that a hinge may be provided somewhere between the front and back ends which allows a front region of the head to pivot relative to a back region thereof. This feature could also be used to impart increased speed and/or spin to the ball. The hinge may alternatively be placed between the head and the shaft of the game stick.

During play on any particular hole, the player may mark the ball's position on the fairway (as is done in golf games) and then placing the ball in the game stick move several steps or paces back toward the starting location from the mark, move rapidly or run toward the target location, and throw the ball no later than when they reach the mark. This action obviously increases the velocity with which the ball is thrown from the head. It is contemplated that the rules and scoring of this new game will generally follow the rules and scoring of golf, with some exceptions that are set out later herein. It should be understood, however, that vastly different rules may be fashioned.

As indicated previously, the game stick itself has a shaft with a head at one end. The head defines a channel on its upper surface and into which the ball is placed. A grip preferably is provided at the opposite end of the shaft so that the game stick may be more easily held onto during the throwing movement when playing the game. The head may include a stop at a rearward first end of the channel which limits movement of the ball in a first direction. An opening is defined at a second end of the channel and it is through this opening that the ball exits the head during a throw.

In one aspect, the invention may provide a channel that together with the back wall is substantially J-shaped along their entire length from the first end thereof to the second end. This shape of the channel affects spin on the ball and creates an arc of flight for the ball.

In another aspect, the orientation of the head relative to the shaft may be adjustable. This feature enables the player to set the channel at a desired orientation relative to the shaft and to thereby manipulate the arc of flight for a ball thrown therefrom. The adjustment assembly is of such a nature as to enable the player to make quick and easy adjustments on the golf course during play. The player therefore does not need to carry a hole range of game sticks to play the game as one will suffice.

In another aspect, the game stick may be used as a putter when the player reaches the target location. To this end, at least a portion of the bottom edge of the head, at its outermost surface, can be straight, such that the head can rest flat on the ground and travel easily across the surface of the ground or grass when pushing or putting the ball at the target location. Additionally, a least a region of an exterior surface of a side region of the head proximate the straight portion can be planar in nature so that it can be used to strike or push the ball during a putting/pushing stroke.

The game stick can be configured so that during play the player will receive at different times a sensation similar to a perfect stroke in golf, the acceleration of throwing a jai-alai ball, and the power of a hockey slap-shot. The fun and challenge of the sport comes from the ability of the player to manipulate the spin, trajectory and distance of the ball in order to achieve precision, to avoid hazards, and to push/putt accurately, thereby getting to the target location and the hole in as few shots as possible.

It should be noted that the game is contemplated to be played by a group of players all throwing their balls down the fairway or by a group of mixed players some of whom are playing traditional golf using traditional clubs and some of whom are playing the new throwing sports using the game stick disclosed herein.

The new sport is more active and includes a more natural and athletic swing for the player than is the case in traditional golf. Additionally, the new sport is easy to learn, has a lower cost of entry, has quicker rounds and increased options for shots, and has simplified rules relative to traditional golf. For these reasons it is contemplated that the new sport will appeal to the younger generation.

It is further contemplated because of the looser swing and more athletic nature of the presently disclosed new sport and because there is no need to strike the ball on the ground as in traditional golf, the new sport could extend the season of a golf course in cooler climates, thus providing additional revenue to the golf course owners.

In one aspect of the invention, a game stick for use with a game ball is provided. The stick includes a shaft having a first end and a second end, where the first end is for gripping a shaft and the second end is attached to a rigid head. The head has (i) a neck for attachment to the shaft, (ii) a back wall extending from the neck curved in a radius to seat a golf ball, (iii) a bottom wall extending from the back wall along which the golf ball may travel from the back wall without interruption when the golf ball is thrown from the game stick, and (iv) side walls extending from the back wall. The bottom wall and side walls define a channel with an open end distal from the back wall through which the golf ball is released when the golf ball is thrown from the game stick. The shaft defines an shaft axis along its length and the channel defines a channel axis along its length, and the shaft axis and channel axis intersect at an obtuse angle. The channel can be between 42 and 50 millimeters in width along its length which is between 2 and 12 inches. The shaft is between 30 and 70 inches long, and the bottom wall extends from the back wall in a path toward the open end along a distance of at least 2 inches that is straight or concave, whereby the ball when under centrifugal force can move uninterrupted along the bottom wall at least three inches before leaving the open end of the channel. In this manner, spin is provided when throwing the ball.

In embodiments, then channel is preferably at least between 3 inches long. In embodiments, then channel can be between 3 and 6 inches long. In embodiments, the channel can be between 3 and 5 inches long.

In embodiments, the side walls can be at least 15, 20, 22, 24, 26, 28, or 30 mm tall (versus the upward facing wall of the bottom wall. In embodiments, the side walls are between 20 mm and 70 mm tall.

In embodiments, at least one side wall defines an aperture for receiving a portion of the golf ball when the ball is positioned against the back wall. In embodiments, each side wall can define an aperture for receiving a portion of the golf ball when the ball is positioned against the back wall. The aperture can be virtually any shape, and in embodiments shown, the aperture is round.

In embodiments, the side walls can be substantially parallel to each other. In embodiments, at least one of the side walls can define a concavity on its exterior surface having a radius of at least 21.3 millimeters, for cradling and pushing a golf ball resting on a ground surface.

In embodiments, the head can include a plurality of apertures for reducing the weight of the head.

In another aspect, the invention may provide a method of playing a game utilizing a game stick and a ball, where the game is played on a course; said method including the steps of:

a) placing the ball in a channel defined in a head of the game stick;
b) gripping an end of a shaft of the game stick which extends outwardly from the head;
c) swinging the shaft to throw the ball toward a target location at an end of a fairway on the game course;
d) moving to a position on the fairway where the thrown ball has landed; and
e) repeating steps a) through d) until the target location is reached.

The method may further include the step of putting or pushing the game ball with a part of the game stick other than the inside surface of the channel when the game ball is resting on a ground surface. In embodiments, the ball can be a golf ball and the game stick can be constructed having dimensions as described herein.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

DETAILED DESCRIPTION

Figure 1:
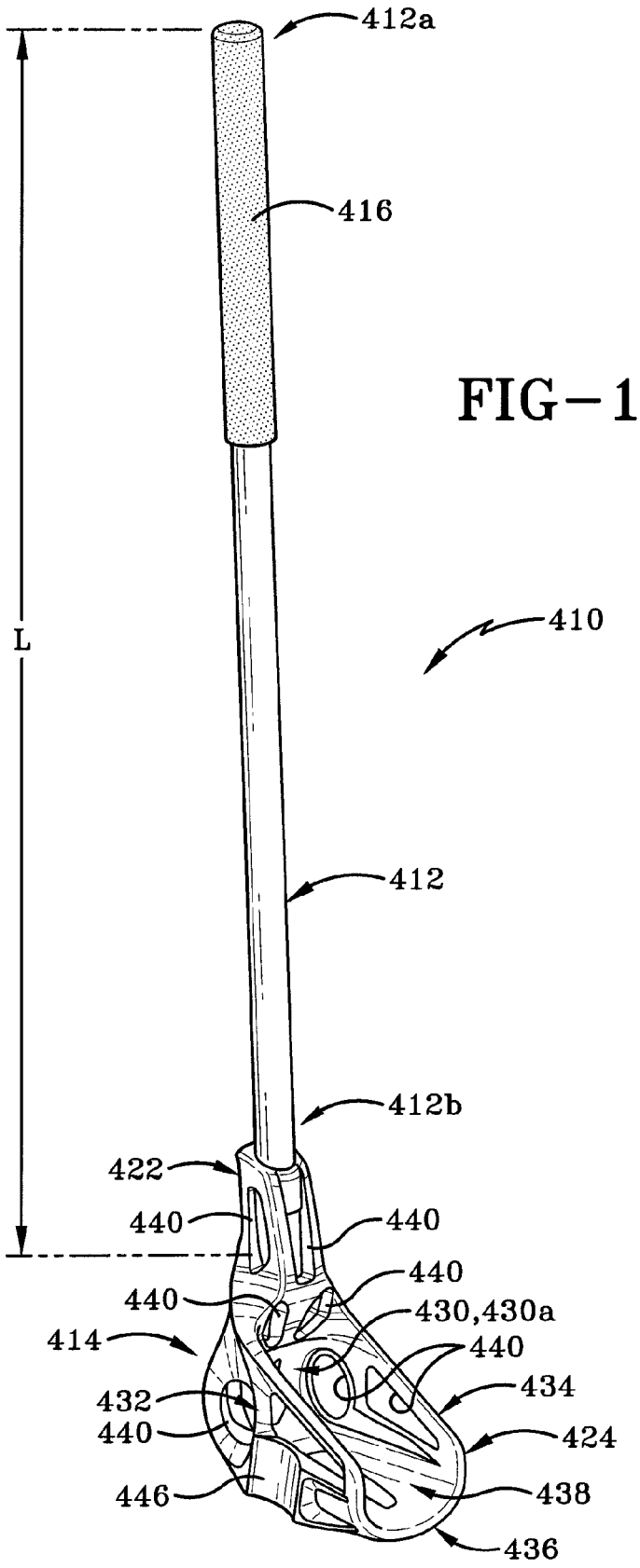
FIG. 1 is a perspective view of a game stick in accordance with an aspect of the present invention.

Referring to FIGS. 1-17 there is shown a new game stick for playing a new sporting game. The game is contemplated to be played upon a course which includes a plurality of discrete locations for play, with the discrete locations being referred to herein as "holes". Each hole includes a starting location and a target location that is positioned a distance away from the starting location. A fairway extends between the starting location and the target location. The course for this new game may be an existing golf course where each hole includes a tee-off location and a flagged cup on a green a remote distance down the fairway from the tee-off location. Alternatively, the course may be a specially-dedicated and/or designed location for the new game.

The game is contemplated to be played with a ball and, preferably, this ball has the general dimensions of a golf ball. It will be understood, however, that other differently dimensioned game balls could be utilized, with the general dimensions of the game stick being selected to be complementary to the game ball utilized. The general objective of the game is to engage the game ball with the game stick and to use the game stick to throw the game ball from the starting location to the target location down the fairway. The distance from the starting location to the target location may require one or more throws of the game ball. Once the target location is reached, the game stick is used to sink the game ball into a cup. A plurality of these holes will be played during the course of a single game. The game stick and the method of playing this new game will be further described herein.

Several embodiments of a game stick in accordance with different aspects of the invention are described herein.

A first embodiment of a game stick in accordance with aspects of the invention is shown in FIGS. 1-6 and is generally indicated herein by the reference number 410. Game stick 410 comprises a shaft 412 and a head 414. Shaft 412 preferably is configured in a similar fashion to a golf-club shaft and comprises an elongated member that has a first end 412*a* and a second end 412*b*. Shaft 412 may be of a substantially constant width, may taper in width from first end 412*a* to second end 412*b* in a similar manner to a standard golf club, or may have a wider region at second end 412*b* proximate head 414 to provide an easier location to engage head 414 therewith.

Shaft 412 may be fabricated from any one or more suitable materials including but not limited to wood, titanium, aluminum, carbon fiber, or plastic and will therefore be relatively rigid. Alternatively, shaft 412 may be fabricated from a material that enables it to be flexible to a greater or lesser degree. For instance, at least a portion of shaft 412 may be fabricated from a rubber which gives it resilience and flexibility. Preferably, the materials selected for shaft 412 will be light-weight so that a player does not have to expend undue effort to play the game.

Shaft 412 may be fabricated to be of a set length "L" (FIG. 1) or shaft 412 may be fabricated so that it is able to telescope in length (not shown). In accordance with one aspect of game stick 410, shaft 412 has a length "L" similar to the length of a standard golf club shaft. The shaft 412 may be, for example, 30-50 inches long, or 35-45 inches long. The shaft is typically longer than 24 inches and typically is shorter than 60 inches. Still further, while shaft 412 is illustrated herein as being substantially straight along length "L" it will be understood that it may also be include one or more bends or angles and that the angle of the shaft entering head 414 may be different to what is shown in the figures. Furthermore, shaft 412 may be offset relative to head 414. It is contemplated that a variety of game sticks 410 in accordance with this disclosure could be marketed to the public and these game sticks 410 could be provided with shafts 412 having lengths that are greater or lesser than length "L" and weights that differ so that a player is able to select the best game stick 410 to suit his or her height and/or ability.

A grip 416 is optionally provided proximate first end 412*a* of shaft 412 and can be configured in a similar fashion to the grip of a golf club, although longer grips are contemplated as the hands may be spaced apart when throwing the ball more so than is typical of hand placement when playing golf. The grip can extend along the entire length of the shaft. The grip 416, therefore, may be at least 6, 8, 10 12, 14, 16, 18 or even at least 24 inches in length. Grip 416 preferably is fabricated from a material suitable to aid the player in adequately gripping shaft 412 as it is swung through the air to throw the game ball, as will be hereinafter described. Grip 416 may therefore be provided with texturing or other means of helping the player to hold onto shaft 412.

Head 414 preferably is fabricated by injection molding a strong, durable, and rigid material such as plastic. Head 414 may alternatively be fabricated so that at least certain portions thereof are not rigid. So, for example, a bottom wall 436 (FIG. 4) of head 414 may not be rigid as this will impart different characteristics to the flight of a game ball 48 thrown therefrom. Preferably, head 414 is fabricated as a single unitary component that is subsequently secured to end 412*b* of a separate shaft 412. It will be understood that head 414 may instead be fabricated from several separate component parts that are subsequently secured together in a suitable fashion, such as by head welding or use of an adhesive. The securement may be of a nature that permits disengagement of head 414 from shaft 412. In this instance, the securement preferably includes a suitable fastener 418 (FIG. 6) which extends through an opening 420 defined in head 414 and engages shaft 412. Any other type of securement such as an adhesive is contemplated to be able to be used herein.

Alternatively, the securement may be of a nature that causes head 414 and shaft 412 to be permanently engaged with each other. Suitable securements in this instance might include heat welding if the head and shaft are fabricated from a plastic material, or if the head and shaft are fabricated from metal the securement could include welding. Still further, it will be understood that instead of head 414 and shaft 412 being separate components; they could instead be fabricated as a single unitary component.

Referring to FIGS. 2-6, head 414 includes a neck 422 and a body 424 (FIG. 2) which extends outwardly and downwardly from a bottom end of neck 422. Neck 422 and body 424 can be integrally formed as a single unitary component. Neck includes a front 422*a*, a back 422*b*, a first side 422*c*, a second side 422*d*, and a top 422*e*. A bore 426 (FIG. 6) is defined in neck 422 and an opening thereto is defined in top 422*e*. As best seen in FIG. 6, bore 426 extends for a distance into the interior of neck 422. Bore 426 is complementary to second end 412*b* of shaft 412 and second end 412*b* is received into bore 426. Fastener 418 extends through opening 420 defined in back 422*b* of neck 422 and through an aligned hole 428 in shaft 412. When fastener 418 is so engaged, shaft 412 cannot be withdrawn from bore 426.

As indicated above body 424 extends outwardly from a bottom end of neck 422. Body 424 includes a back wall 430, a first side wall 432, a second side wall 434, and a bottom wall 436. Back, first and second side and bottom walls 430-436 are integrally formed with each other and are substantially continuous with each other. Back wall 430 has an interior surface 430*a* and an exterior surface 430*b*. First side wall 432 has an interior surface 432*a*, an exterior surface 432*b*, a front edge 432*c* and a top edge 432*d*. Second side wall 434 has an interior surface 434*a*, an exterior surface 434*b*, a front edge 434*c* and a top edge 434*d*. Bottom wall 436 has an interior surface 436*a*, an exterior surface 436*b* and a front edge 436*c*.

The interior surfaces of back, first and second sides, and bottom walls 430*a*-436*a* bound and define a channel 438. Channel 438 has a width as measured between interior surface 432*b* and 434*b* at the center point of the ball when the ball is in the channel and this width along the length of the channel is configured to be generally equal to but slightly larger than the diameter of a game ball 48. In this manner, the game ball can roll along the interior surface 436*a* of the bottom wall 436 from one end of the channel to the other. The width can be configured to be only a fraction of a millimeter wider than the diameter of a golf ball. In embodiments, however, the width can be 25, 50, 100 or more millimeters wider than the diameter of a golf ball. In the embodiment shown, the channel 438 is about 44 millimeters, less than about 2 millimeters wider than the diameter of the golf ball (42.67 millimeters).

Front edges 432*c*, 436*c*, 434*c* define a first opening to channel 438. In the embodiment shown, top edges 432*d*, 434*d* defined a second opening to channel 438, whereby the ball may be placed in the channel along substantially all of its length. In the embodiment shown, side walls extend outwardly from the bottom wall. Once the side walls reach a height defined by the mid-point of the game ball in the channel, the walls maintain a channel width at least the width of the game ball over the remainder of their height.

As is evident from FIGS. 1-6, a plurality of through-apertures 440 are defined in neck 422 and body 424 of head 414. Apertures 440 are provided for a number of purposes. Firstly, they reduce the overall weight of head 414 and thus of game stick 410. Secondly, they permit airflow therethrough and this aids in moving a game ball 48 (FIG. 2) through channel 438 as will be later described herein. The placement, size and shape of the various apertures 440, in general, may be changed as desired and the placement, size and shape thereof should not be considered to be limited to the exact configuration shown herein.

Figure 2:
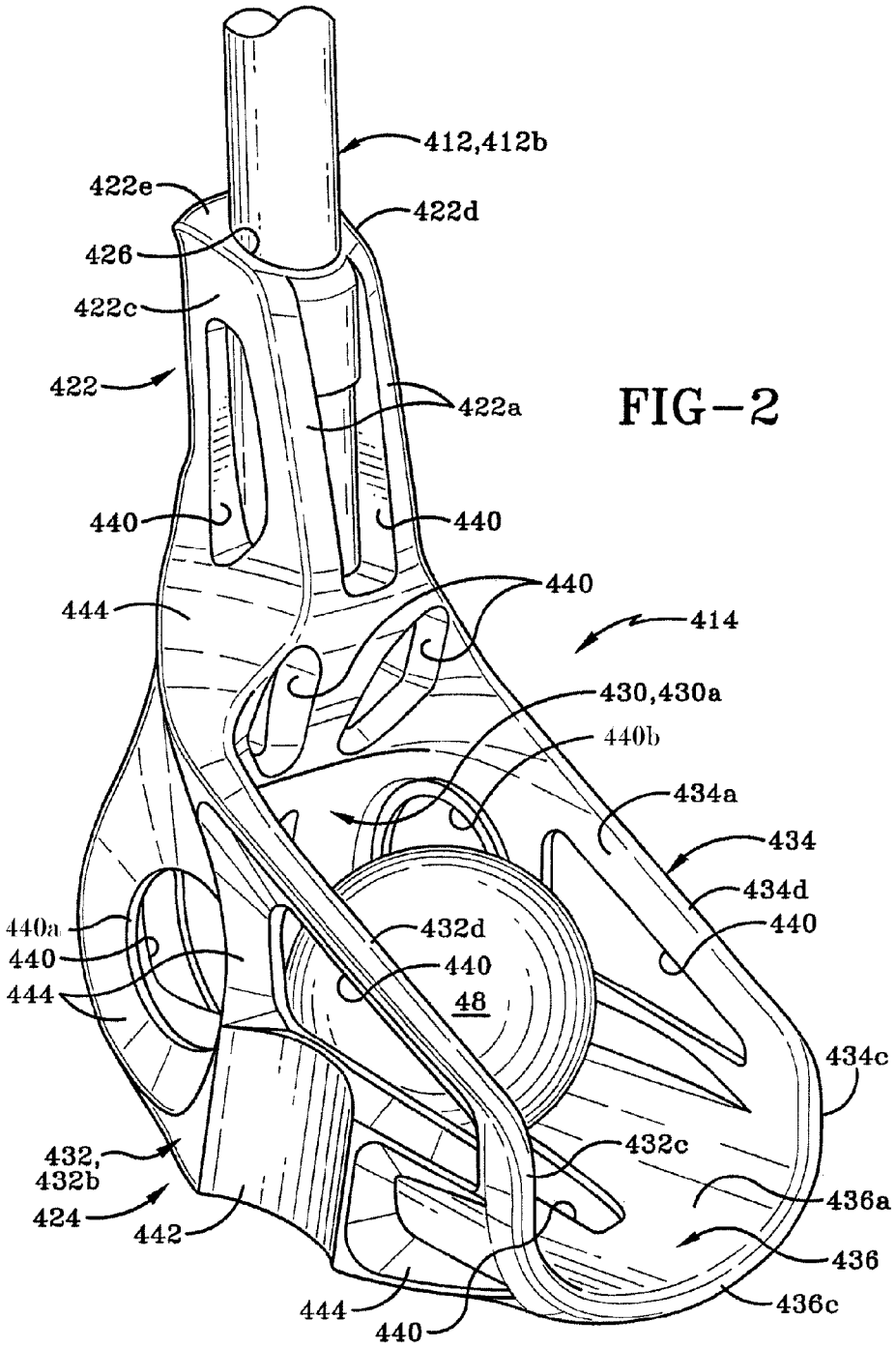
FIG. 2 is a perspective view of the head of the game stick of FIG. 1, showing a ball retained in a channel defined therein.
Figure 4:
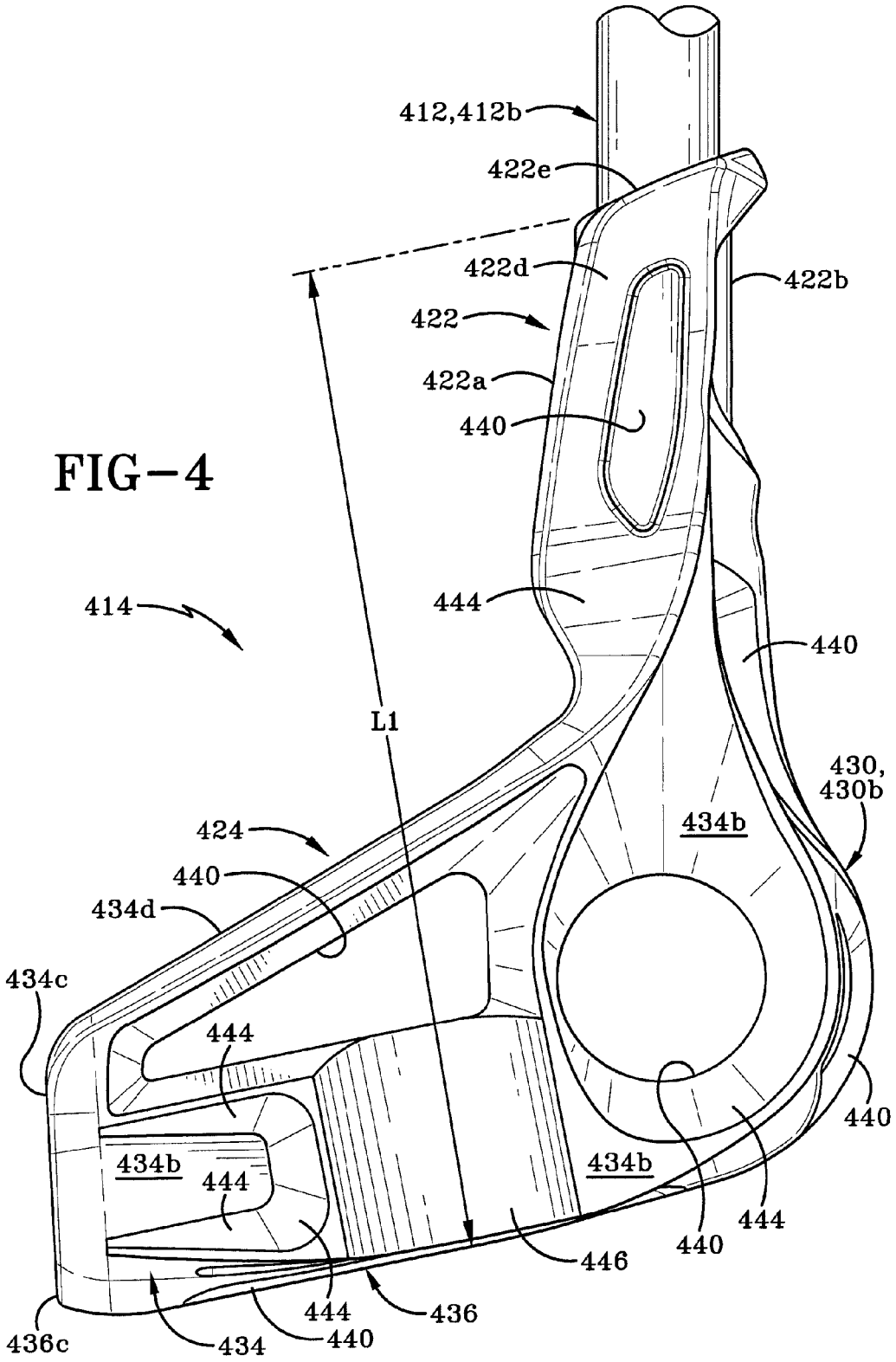
FIG. 4 is a right side view of the head shown in FIG. 2.
Figure 5:
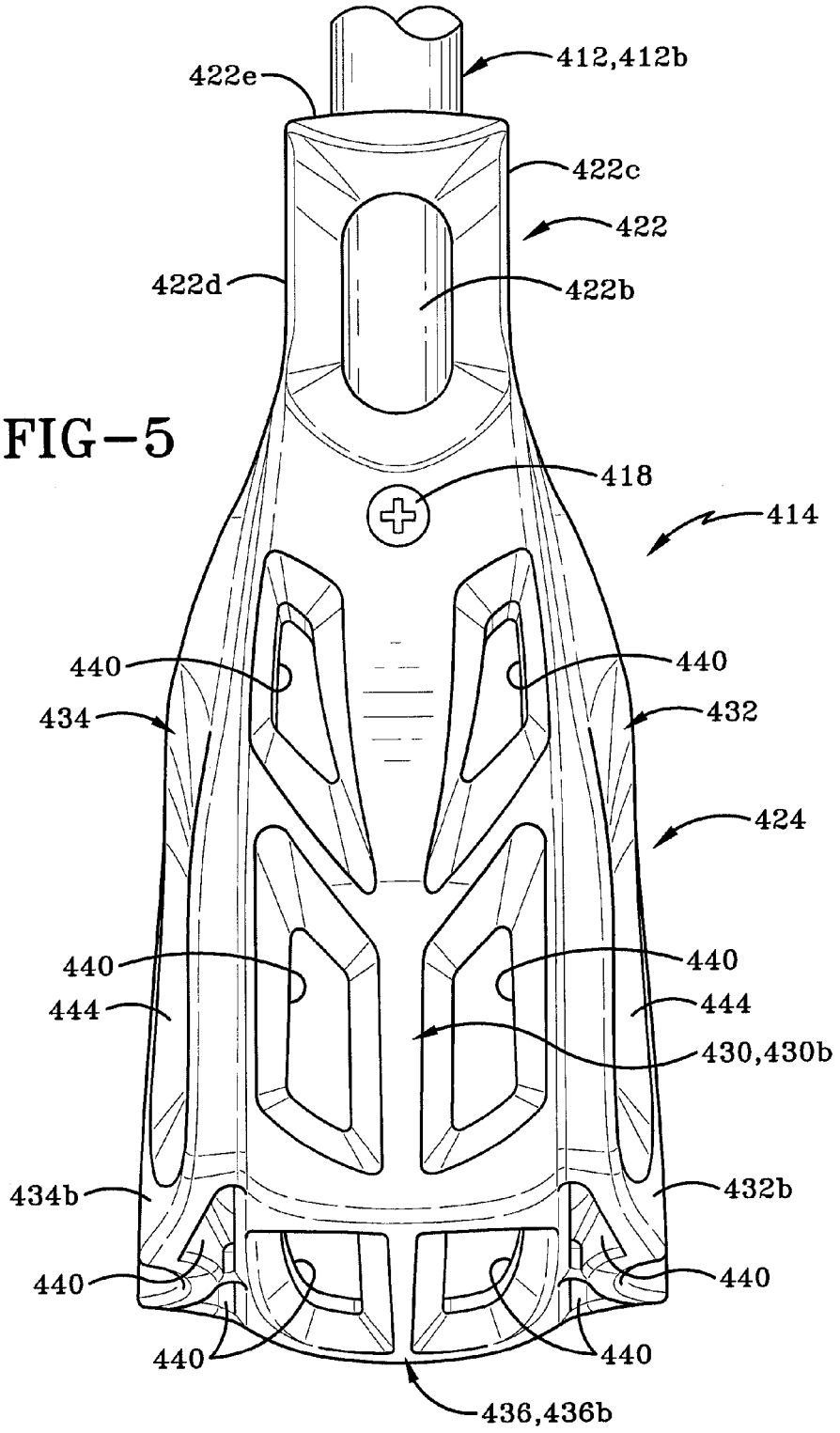
FIG. 5 is a rear view of the head shown in FIG. 2.

Two apertures, however, serve an additional purpose. As shown in FIGS. 2, 4, and 6, apertures 440*a* is located on side wall 432 and a corresponding aperture 440*b* is located on side wall 434, each aperture near the back wall 430. These apertures 440*a*, 440*b* can stabilize the game ball when the game ball is seated against the back wall and the head 414 is tilted from side to side. The apertures 440*a* are round and define an axis running there between that passes through the center of the ball when the ball is seated in the 'cradle' defined by the back wall, which back wall matches the curvature of the game ball. The apertures 440*a*, 440*b* effectively widen the channel at the back wall, such that when the game ball is in the 'cradle', the ball can roll from side to side extending into aperture 440*a* when the device is tilted toward the side wall 432 and can roll into the aperture 440*b* when the device is tilted toward the side wall 434. This aspect of the invention yields results that are surprising. It was expected that a tight channel just slightly larger than the diameter of the game ball would minimize lateral movement of the ball in the channel. However, it was discovered that in use, the ball would tend to 'rattle' in the channel when seated at the back wall. Although the apertures 440*a*, 440*b* widen the channel along the axis between the apertures, these apertures themselves tend to cradle the game ball and inhibit movement of the ball when the head is tilted to the left or right. In one embodiment using a golf ball as a game ball, the aperture is approximately 25 millimeters in diameter. It can, however, be smaller or larger, such as between 2 mm and 35 mm, or between 5 mm and 30 mm. It will be understood that the ideal size apertures 440*a*, 440*b* will depend at least on the size of the game ball.

In addition to the apertures 440, head 414 is provided with a plurality of angled surfaces such as indicated at 444 (FIGS. 2-5) which reduce weight and enhance the airflow around and through head 414 and the apertures 440 therein. The surfaces 444 also give head 414 a more aesthetically pleasing appearance.

As shown in FIG. 1, head 414 is provided with a surface 442 that is used to push game ball 48 along a ground surface when the target location is reached. The surface 442 may be provided on any region of head 414. In other words, the surface may be provided at the exterior surface 430*b* of back wall 430, at one or more of exterior surfaces 432*c*, 434*c*, and 436*c*, on one of the side walls 432, 434.

By way of example, the pushing surface 442 on head 414 can be a concavity 446 (FIG. 4) that is provided on one or both of side walls 432, 434. Concavity 446 has a radius of curvature that is complementary to the curvature of game ball 48. Concavity 446 is useful for pushing the ball 48 into a hole on the course when the target location is reached, as will be hereinafter described. Ball 48 may be placed immediately adjacent concavity 446 and game stick 410 manipulated so that ball 48 is pushed toward the hole.

Concavity 446, when in the shape of a partial cylinder as shown, can be disposed substantially perpendicular relative to the ground surface when the bottom of the head 424 is placed on the ground. In this position, shaft 412 is in a plane perpendicular to the ground surface and the shaft is positioned at an angle defined by the oblique angle between the shaft axis and channel axis. The angle of the shaft to the ground is similar to that when putting a golf ball.

As will be understood, surface 442 need not be in the shape of a partial cylinder. The surface can be, for example, in the shape of a partial sphere. It also can be rectangular in shape. It also can be a flat surface, with or without protrusions for cradling the game ball. If a flat surface, the ball can be pushed or even putted in the same manner as occurs with the head of a golf putter. Still further, the surface for pushing or putting game ball 48 could also be convex in shape, but this configuration may make it a little more challenging for a player to control the direction in which a pushed or putted game ball would move.

Thus, head 414 can be positioned to present the pushing or striking surface, in this instance, concavity 446, in order to push, putt or make any type of action used to direct the game ball 48 toward the sunken cup at the target location.

It is also contemplated that the surface for pushing or putting the ball may be provided elsewhere on the game stick 410. For example, the pushing/striking surface may be provided on the grip end 416 of stick 416. Furthermore, the pushing/striking surface may be retractable into the region of game stick 410 on which it is provided. When it is desired to putt or push game ball 428, a suitable activation mechanism will be engaged so that the striking surface is extended to a position where it may be used to putt or push a ball on the ground surface. Furthermore, the pushing/striking surface may be detachably inserted into an end of the game stick.

Figure 6A:
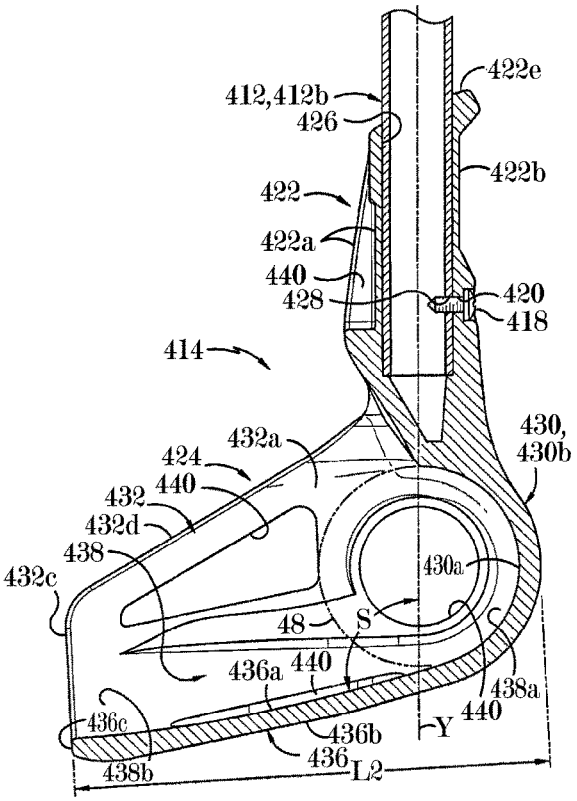
FIG. 6*a* is a right side cross-sectional view of the head shown in FIG. 2, with the shaft extending upwardly, perpendicular to a ground surface.
Figure 6B:
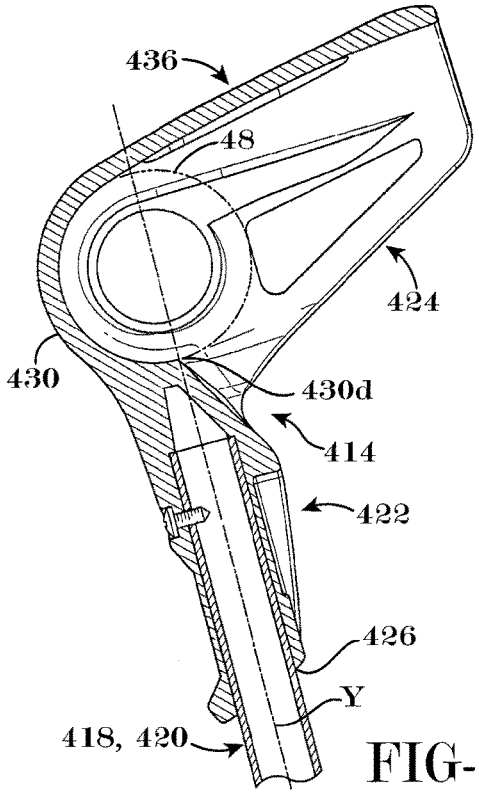
FIG. 6*b* is a right side cross-sectional view of the head shown in FIG. 2, with the shaft extending downwardly at an angle to a ground surface.

Referring to FIG. 6*a*, it will be seen that the inside surface of back wall 430 is also concave in shape. In particular, the radius of curvature of interior surface 430*a* of back wall 430 is such that it is complementary to the curvature of game ball 48. Game ball 48 is shown in phantom in FIG. 6*a* and it can be seen that the ball 48 is able to be seated with the curvature of back wall 430 but because only a portion of the exterior surface of ball 48 is in contact with back wall 430, ball 48 is seated or cradled therein but is not retained therein. In embodiments, the distance of the radius of contact can be less than 180 degrees. In embodiments, the distance of the radius of contact can be between about 120 to 165 degrees, although smaller ranges and larger ranges are permitted. As can be seen in FIG. 6*b*, when the stick is inverted such that the grip is toward the ground and the angle T of the shaft is at about 15 degrees from vertical, the ball is held in this 'cradle' making it less likely that the ball will fall from the channel in use. In other words, the end 430*d* (closest to the shaft) of the radius forming the cradle is at about an axis extending through the center of the ball and perpendicular to the ground surface when the shaft is perpendicular to the ground surface. Thus, any tipping of the shaft toward the back wall will create a lip which will hold the ball preventing it from falling from the cradle Referring still to FIG. 6*a*, bottom wall 436 is disposed generally at an obtuse angle "S" relative to longitudinal axis "Y" of shaft 412. Angle "S" may be varied in different heads in accordance with an aspect of the present invention so as to impart a different slope to bottom wall 436 so that the ball 48 will break differently from different head configurations. Preferably angle "S" is from about 105° to about 165°, and in embodiments can be 110° to about 150° or even 110° to about 135°. In the embodiment shown, the angle is about 108°.

Head 414 also has a length "L2" as measured from front edge 436*c* of bottom wall 436 to a rearmost region of the exterior surface 430*b* of back wall 430. This length "L2" may be varied on different head configurations in accordance with an aspect of the present invention. Typically, the length L2 will be between 2 and 8 inches. In one embodiment, length "L2" is about 3¾ inches and the width of channel 436 between side walls 432 and 434 is about 1¾ inches. Channel 438 is only slightly shorter than length "L2" by about the thickness of back wall 430. Different length bottom walls 436 and therefore channels 438 will impart different ball flight and throwing characteristics to head 414.

In accordance with one aspect of the invention, the ratio of the shaft length "L" relative to the channel length "L2" is at least 6:1, 7:1, 8:1, 9:1, 10:1, 11:1, 12:1, 13:1 or even 14:1.

Figure 3:
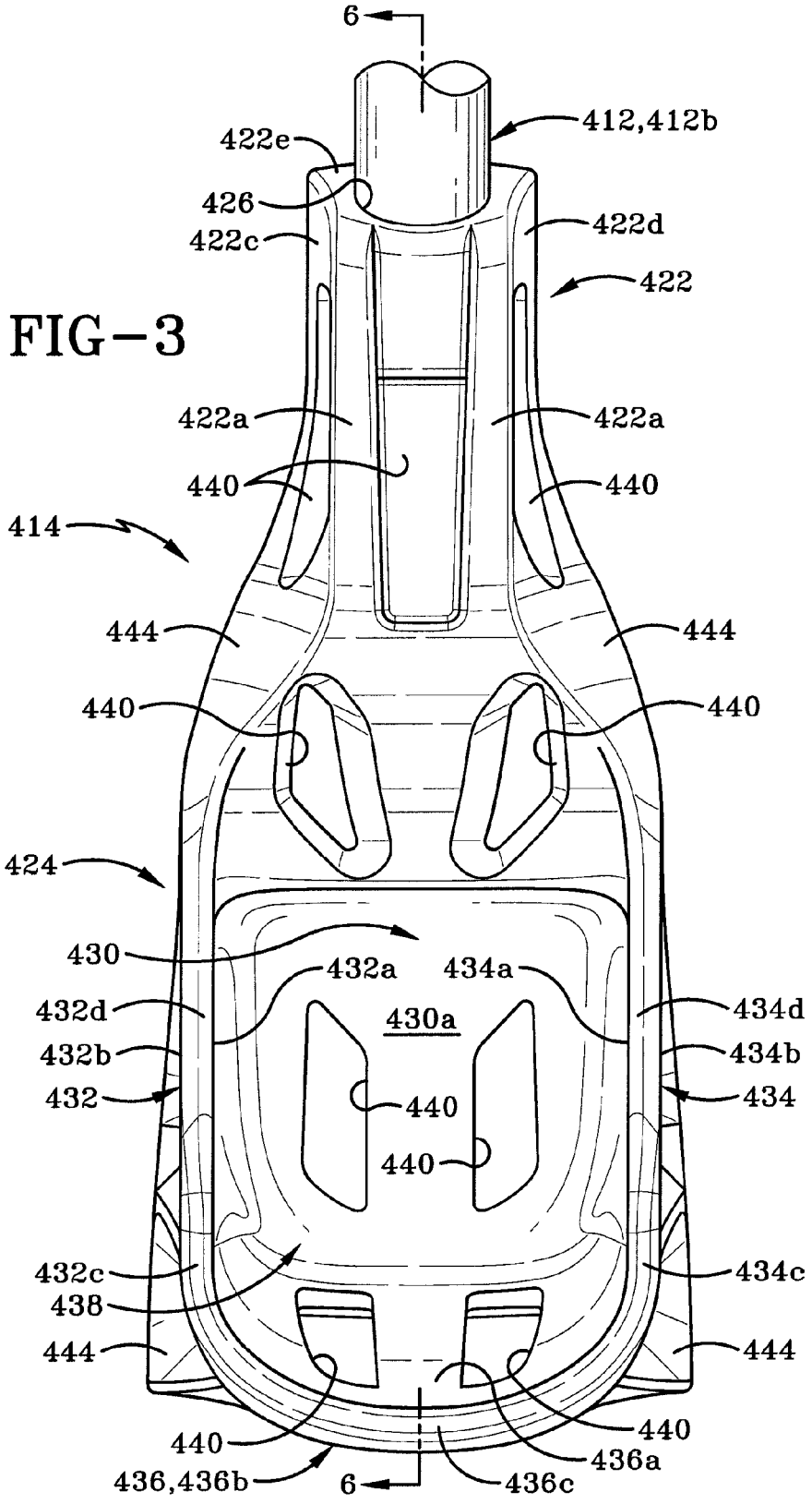
FIG. 3 is a front view of the head shown in FIG. 2.

First and second side walls 432, 434 can be mirror images of each other and originate at bottom wall 436 and extend upwardly and outwardly therefrom. Top edges 432*d*, 434*d* extend outwardly and forwardly from back wall 430 and neck 422 and terminate at front edges 432*c*, 434*c*, respectively. Top edges 432*d*, 434*d* angle downwardly from proximately back wall 430 to front edges 432*c*, 434*c*. Thus, side walls 432, 434 taper in height relative to bottom wall 436 from proximate the back of head 414 to the front thereof. As best seen in FIG. 3, interior surfaces 432*a*, 434*a* of side walls 432, 434 are generally disposed at right angles to bottom wall 436. Furthermore, side walls 432, 434 may be parallel to each other as illustrated in FIG. 3 as this enables ball 48 to move in a guided fashion down channel 438. It will be understood, however, that side walls 432 434 may slope slightly toward each other, slightly away from each other and/or may be concave to match in part the curvature of a game ball.

FIG. 6*a* shows that the interior surface 436*a* of bottom wall 436 is substantially smooth and unbroken by any type of ridge or other obstruction. This ensures that ball 48 will roll smoothly along interior surface 436*a* during play. Likewise, the interior surfaces of each side wall which can be in contact with the game ball as the game ball rolls along the bottom surface is substantially smooth and unbroken by any type of ridge or other obstruction for the same reason. The walls, however, can be roughened, to promote better friction with the ball in order to impart more spin.

In the embodiment shown, the channel in cross-section as defined by the bottom and side walls does not define a surface that matches exactly the radius of the golf ball. The channel in cross-section is somewhat irregular. As a result, when the head is tilted to one side at an angle of, for example, 45 degrees, the game ball is in contact with two points of the channel, one along the interior surface of the bottom wall and one along the interior surface of a side wall. This has worked well in practice, although a channel with a more regular radius can result in the game ball only contacting a single point in the channel, also contemplated to be within the scope of the invention.

It should be noted that instead of neck 422 and therefore shaft 412 being disposed at an angle ""S" relative to bottom wall 436 of head 414, the angle of neck 422 relative to body 424 may be varied in different heads 414 in accordance with the invention. If this is the case, then shaft 412 will be oriented at an angle other than "S" relative to bottom wall 436.

Figure 7:
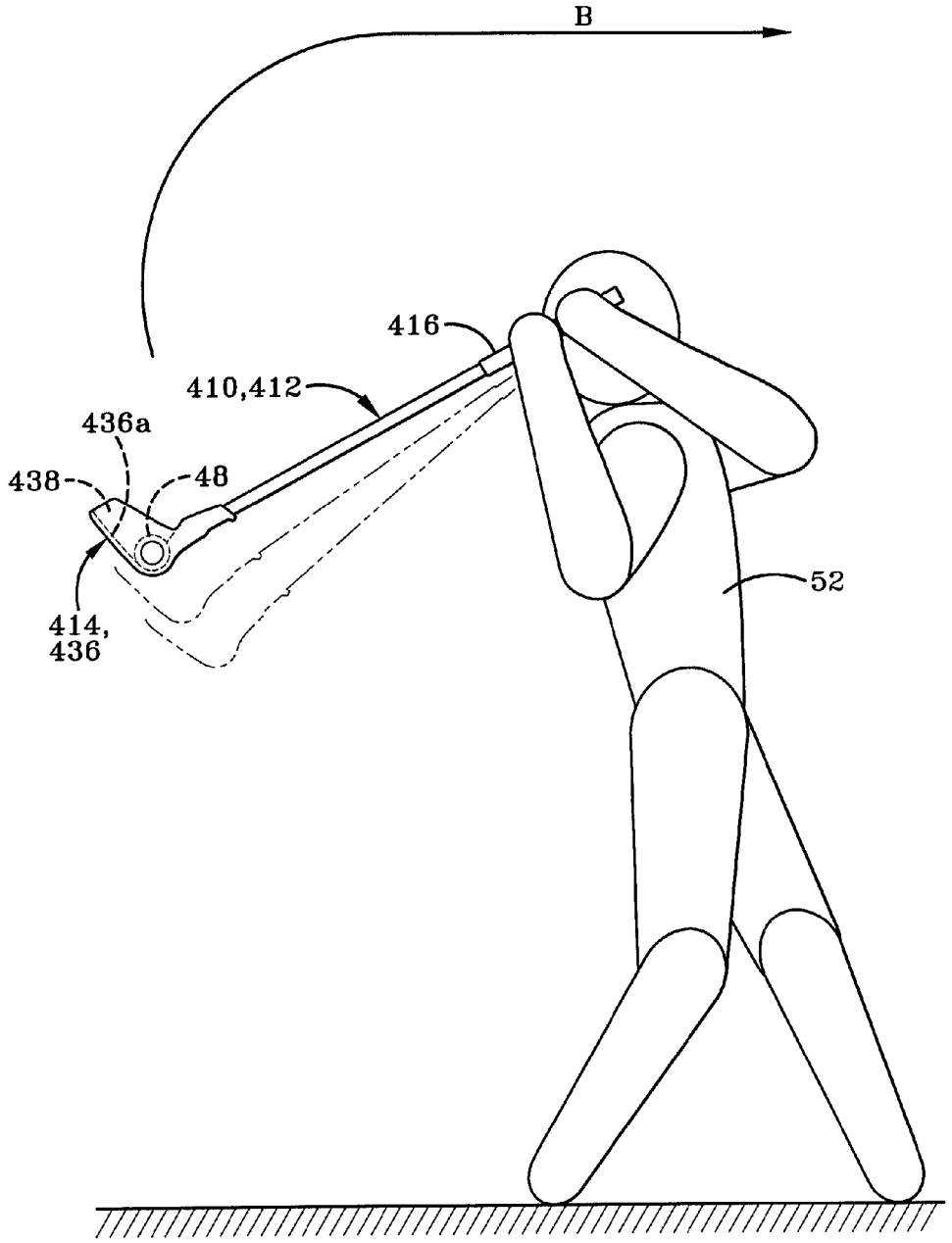
FIG. 7 is a diagrammatic illustration of a person in an initial position for throwing a ball using the game stick in accordance with an aspect of the present invention.
Figures 8A, 8B, 8C:
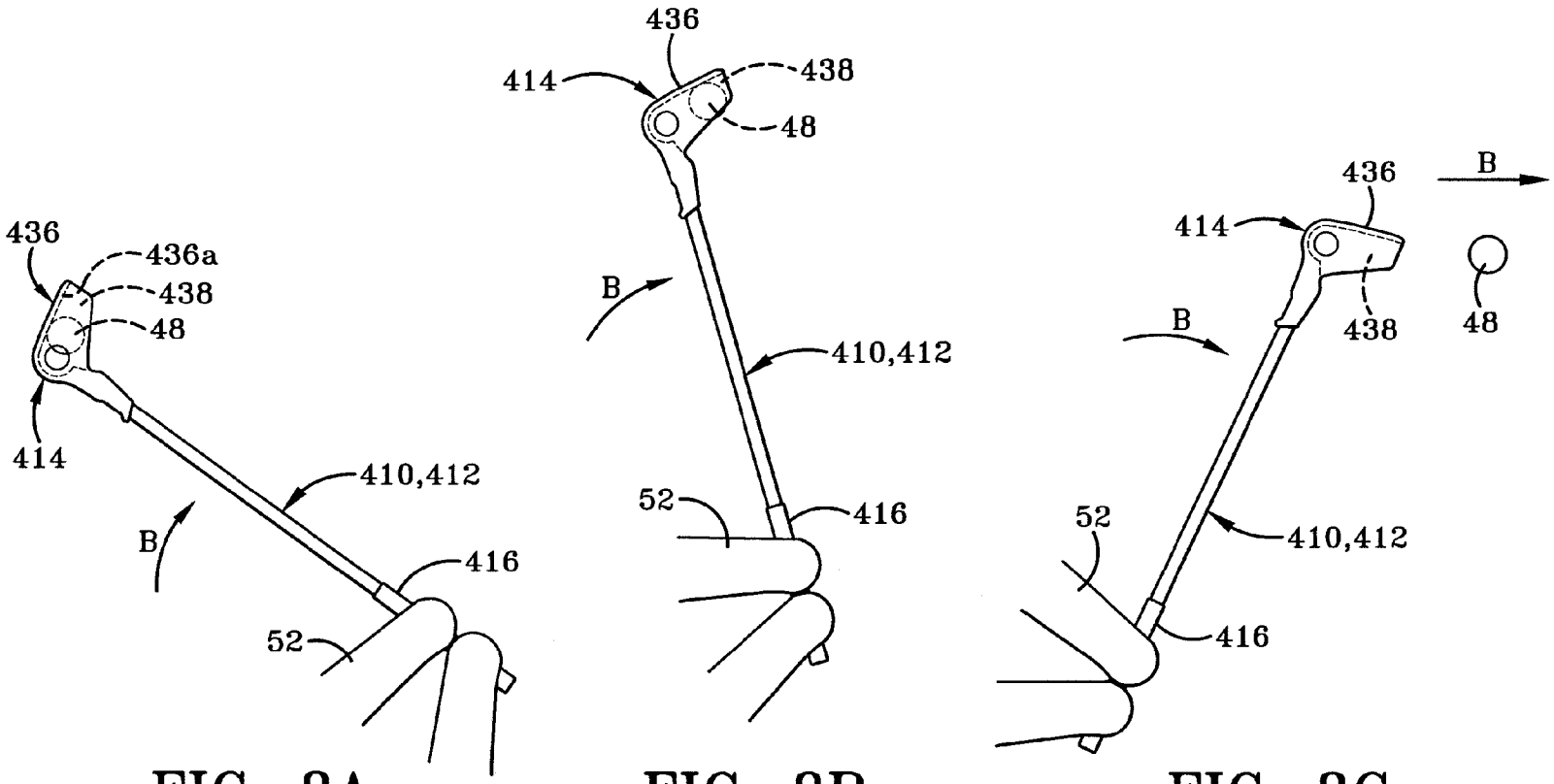
FIG. 8A is diagrammatic side view of the game stick in a position where it is ready to be used to throw a ball, and showing the ball in an initial position at a first end of the channel.
FIG. 8B is a diagrammatic side view of the game stick part way through a player throwing the ball and showing the ball in a second position within the channel and intermediate the first and second ends of the channel.
FIG. 8C is a diagrammatic side view of the game stick after the ball has been released through the opening at the second end of the channel and showing the ball traveling in the direction of the throwing movement of the game stick.
Figure 9:
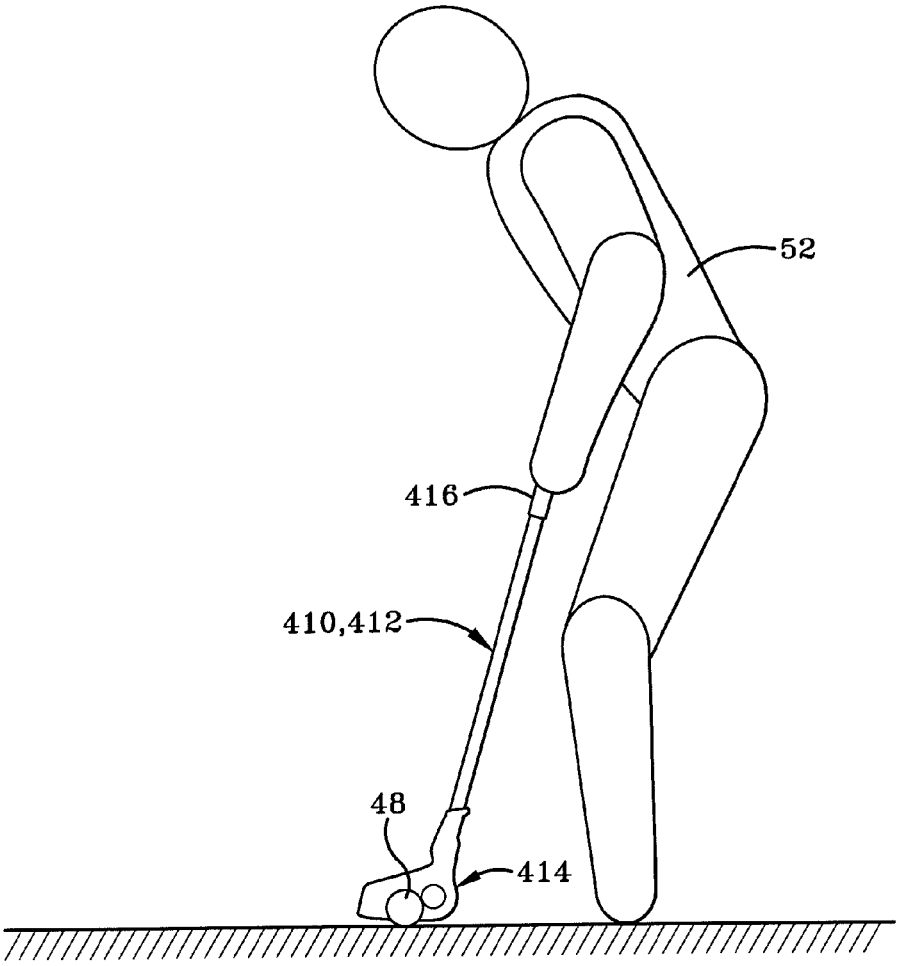
FIG. 9 is a diagrammatic side view of the a player putting the ball with the game stick.
Figure 10:
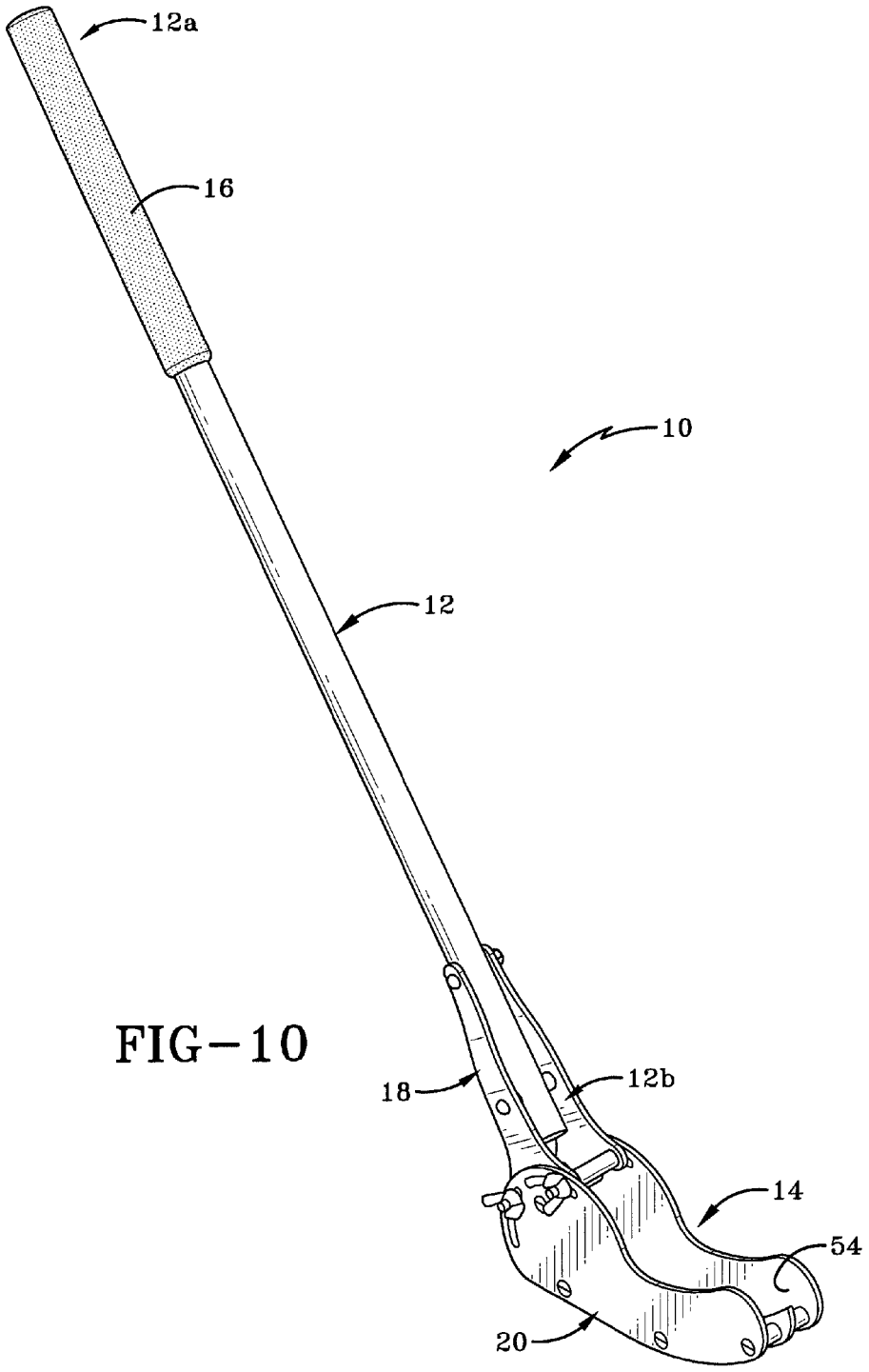
FIG. 10 is a right side perspective view of a second embodiment of a game stick according to the invention.

Referring to FIGS. 7-9, game stick 410 is used to play the new sport that is contemplated to be played on a course. As indicated previously herein, the course could be a dedicated course or an existing golf course. Furthermore, the game stick and game ball 48 are configured to be complementary to each other. For the purposes of this description only, play will be described with reference to play on an existing golf course with a standard golf ball being used as game ball 48. Since golf courses are well known, the layout of the course and of holes on the course will not be further described or illustrated herein. Suffice to say that the starting location for the new game will be the equivalent of a tee-off location on a golf course, the target location will be the equivalent of a green on a golf course which includes a cup into which the golf ball is to be sunk; and a fairway separates the target location from the starting location.

The new game is similar in nature to golf in that the player starts play at the starting location at a first hole of the golf course. The player will complete the first hole and then play a second hole and so on until they have played a particular, set number of holes on the course—such as nine holes or eighteen holes, for example. (It will be understood that any other desired number of holes may constitute play of this new game.). Instead of the player standing at a tee-off location at any respective hole, placing ball 48 on a tee and then striking the game ball 48 with the head of a golf club to cause the ball to move down the fairway toward the target location, the player stands at the tee-off location and places game ball 48 into channel 438 of game stick 410. The player may swing or otherwise move the head of game stick 410 backwardly in a first direction. The stick may be swung or moved in any manner, including, but not limited to, that similar to a swing of a golf club, lacrosse game stick, jai-alai game stick, hockey game stick, or even a tennis racquet. In other words, the player may move stick 410 to a position for an overhand throw, an underhand throw, or a throw similar to a backhand, a forehand, a slice, or a volley, in motions similar to strokes played in tennis. In any of these motions game stick 410 is typically initially swung in a first direction and then subsequently swung in a second direction. Typically, if the player 52 is standing at the tee-off starting location and is facing the target location, the first movement will place the head of game stick 410 behind the player's back and the second swing will move the head of game stick 410 to a position generally in front of the player.

FIG. 7 shows, in diagrammatic form, a player 52 with stick 410 in a position suitable to make an overhand throw. The player will then use stick 410 to throw the ball in a direction represented by arrow "B" (FIGS. 7-8C). If the stick has been swung rearwardly prior to making the throw, then the rearward motion will have been more or less in an opposite direction to arrow "B". As game stick 410 is swung forwardly, ball 48 moves, by way of centrifugal force, along channel 438 from a first position proximate first end 438*a* (FIG. 6) of channel 438 toward a second end 438*b* thereof and passing through positions in channel 438 intermediate first and second ends 438*a*, 438*b* (FIG. 8B, 8C). Second end 438*b* of channel 438 is not obstructed by any walls or fasteners extending between first and second sides 432, 434. Thus, when ball 48 reaches second end 438*b* of channel 438, it exits head 14 through an opening defined by front edges 432*c*, 436*c*, 434*c*. Because game stick 410 is being swung in the direction of arrow "B", motion in the direction of arrow "B" is imparted to ball 48 (FIG. 8C). Ball 48 thus travels down the golf course fairway for a distance. The distance may be substantial, for instance, a couple of hundred yards.

Player 52 will walk to where the ball 48 has landed on the fairway and will take a second throw in the direction of the target location at the end of the fairway. On a golf course, player 52 will take a second throw aiming at a flag on a green at the end of the fairway in question, because the flag indicates where the sunken cup is positioned on the green. In accordance with rules of the present game, set out hereafter, player 52 may place a mark on the fairway to indicate where his ball 48 has landed. Player 52 is permitted to pick up ball 48 and once again place it in channel 438 of game stick 410 to ready himself or herself for a second throw on that particular hole. Player 52 may move several paces away from that mark in the opposite direction to the green, i.e., toward the starting location (on a golf course, toward the tee-off location) and is then permitted to move rapidly or even run toward the mark on the fairway and in the direction of the target location and to throw ball 48 from game stick 410 at or before the mark he or she previously placed on the golf course. (It should be understood that the player may also use a running start at the tee-off location for the first throw.)

Each throw is the equivalent of a stroke played by in a typical golf game and is scored accordingly. Player 52 will throw a first throw in a similar way to a golfer playing a first stroke. The player 52 will then walk (or drive in a golf cart) to where his or her ball 48 landed on the fairway and throw the ball 48 a second time, and so on. The player 52 attempts to get game ball 48 onto the green at the end of the fairway (the target location) in much the same way as a golfer will do who is playing strokes with a golf club.

When ball 48 lands proximate the target location such as on the green, the player 52 changes his or her hold on grip 416 so that game stick 410 is able to be used as a type of putter. This is illustrated in FIG. 9. Player 52 will position head 414 such that exterior surface 436*b* of bottom wall 436 or a second region of one or both of side walls 432, 434 is disposed parallel to and adjacent the green upon which ball 438 rests when the shaft is retained at an angle, typically from about 65° to about 90° relative to the green. Simultaneously, the putting or pushing surface, i.e., concavity 442 illustrated herein, is positioned generally at right angles to the green. Head 414 is furthermore positioned so that concavity 442 is adjacent ball 48. Because of the curvature of concavity 442, player 52 will tend to push the ball 48 with head 414 instead of putting the ball 48. In other words, player 52 will try and ensure that substantial contact between head 414 and ball 48 is maintained during the stroke instead of swinging head 414 away from ball 48 in a first direction and then swinging head 414 in a second direction and back into contact with ball 48. If the putting surface is a flat planar surface, then the ball will be putted in the same manner as a golf ball being struck by a golf putter.

It should be noted that bottom wall 436 and or the second regions of one or both side walls 432, 434 preferably are substantially flat/planar to slightly curve along its entire length and width and are free of any ridges or protrusions which could accidentally contact the green as head is moved to push ball 48. In other words, bottom wall 436 and/or second regions of side walls 432, 434, can be substantially smooth along their entire length and width. In general, the bottom should be free of protrusions that would hinder smooth movement of the head along a green, such as is the case with a putting iron.

Player 52 putts or pushes ball 48 in order to try to sink ball 48 in the sunken cup adjacent the flag on the green. So, on a par four hole, for example, player 52 will try and throw ball 48 and then subsequently push/putt ball 48 to sink the same in the cup in a total of four plays. The game is scored in a similar fashion to traditional golf, i.e., in accordance with the Rules of Play referenced in the Background herein, with some exceptions. These exceptions include but are not limited to:

1. When starting play on a hole—the player may take several steps to throw the ball but they cannot release the ball if their feet cross the line between the tee blocks (i.e., the tee-line) at the starting location. In the case where the tee blocks do not permit at least a fifteen foot area for the player to take several steps, a mark will be placed fifteen feet from the back of the tee box. This will become the new tee-line which the player's feet cannot cross when they make their first throw for the hole.
2. Where rules apply to the lie of the ball—in the new sport the ball is marked and picked up to be placed in the channel of the head. The player is permitted to walk back along the line that the ball was thrown (i.e., toward the starting location on the hole) up to five paces, i.e., five steps. The play can then take a number of steps (five or less) back toward the mark but not beyond the mark (i.e., toward the green), and throw the ball. The steps taken back toward the mark can be walked or run.
3. Where the ball comes to a stop in a sand trap on the golf course—in the new sport this can be an automatic one stroke penalty. The player may then remove the ball from the sand trap, step back five paces from the edge of the trap along the line that the ball entered the trap and in the direction of the starting location, and then throw the ball using game stick 410. The player may move toward the sand trap while throwing the ball but must throw before the edge of the trap.
4. Where the ball comes to a stop in a water hazard—this is an automatic one stroke penalty. The player is able to remove the ball from the water hazard (or select a new ball), step back five paces from the edge of the water hazard and along the line that the ball entered the same, (in the direction of the starting location) and then throw the ball from the club. The player may move toward the water hazard while throwing the ball but must throw before the edge of the hazard.
5. Where the ball comes to a stop out of bounds this is an automatic one stroke penalty. The player may mark the location up to five paces laterally (i.e., in a direction that is generally across the width of the fairway) from where the ball entered the out of bounds area, and then step back five paces from that mark (in the direction of the starting location), and then move forward toward the mark in order to throw the ball. The player cannot throw at a point past the mark in the direction of the green.

6. When throwing the ball—the player must remain on a line between any mark that has been placed and the five paces back toward the starting location. The player can throw in any desired direction but must themselves travel along the line that was paced. In other words, the player cannot approach the mark from a different angle than the angle they initially moved away from the mark.

It will be understood that types of target locations other than a flagged hole on a green and types of ending plays at those target locations, other than sinking the game ball 48 in a sunken cup at the target location, may be incorporated into the new game.

FIGS. 7-9 illustrate the game stick 410 in use during play of the game. The game course is not illustrated herein as it will be understood that for the purposes of this description the game course is an existing golf course. The player will sequentially play each of the holes on the course in the manner previously described herein and the following methodology references the playing of a single hole.

In accordance with an aspect of the new game, a method of playing the game is disclosed utilizing a game stick 410 and a ball 48; and wherein the game is played on a game course includes the steps of:

a) placing the game ball 48 in a channel 438 defined in a head 414 of the game stick 410;
b) gripping an end 412*a* of a shaft 412 of game stick 410 that extends outwardly from head 414;
c) moving the shaft 412 to prepare to throw ball 48 therewith;
d) moving the shaft 412 and thereby the head 414 toward a target location at an end of a fairway on the game course;
e) releasing ball 48 through an opening at one end of channel 438;
f) moving to a position on the fairway where the thrown ball 48 has landed; and
g) repeating steps a) through f) until the target location is reached.

During play, the step of swinging shaft 412 includes swinging shaft 412 through the air and without head 414 touching the ground surface of the game course upon which the player stands.

The method further comprises the step of pushing or putting ball 48 with the head 414 of game stick 410 toward a sunken cup situated at the target location. When ball 48 is to be putted, as is shown in FIG. 9, the player 52 grasps grip 416 in much the same fashion as with a regular golf club and holding shaft in a plane substantially perpendicular to the ground, places a bottom surface of head 414 on the grass of the green adjacent ball 48. This bottom surface of head 414 extends substantially parallel to the ground surface and may comprise a region of bottom wall 436 or of one or both side walls 432, 434. This bottom surface preferably is substantially flat and smooth so the head will glide easily over the ground surface during putting or pushing of ball 48 toward the hole using head 48.

The method further comprises the step of rolling or sliding ball 48 along channel 438 in head 414 as shaft 412 is swung through the air. The step of rolling or sliding ball 48 includes moving ball 48 along channel 438 by way of centrifugal force.

Referring now to FIGS. 10 to 17 additional embodiments of a game stick in accordance with various aspects of the present invention. Each of these different embodiments will be described briefly and will then be further described later herein. FIGS. 10-14 show a second embodiment of a game stick in accordance with an aspect of the invention, generally indicated at 10. Game stick 10 includes a shaft 12 and a head 14. Head 14 may be fabricated from several separate smaller plate members (22, 24, 30, 32, 44) that are joined together in specific combinations to form a first part 18 and a second part 20 of head 14. The first part 18 is secured to shaft 12 and the second part 20 is secured to first part 18.

Figure 15:
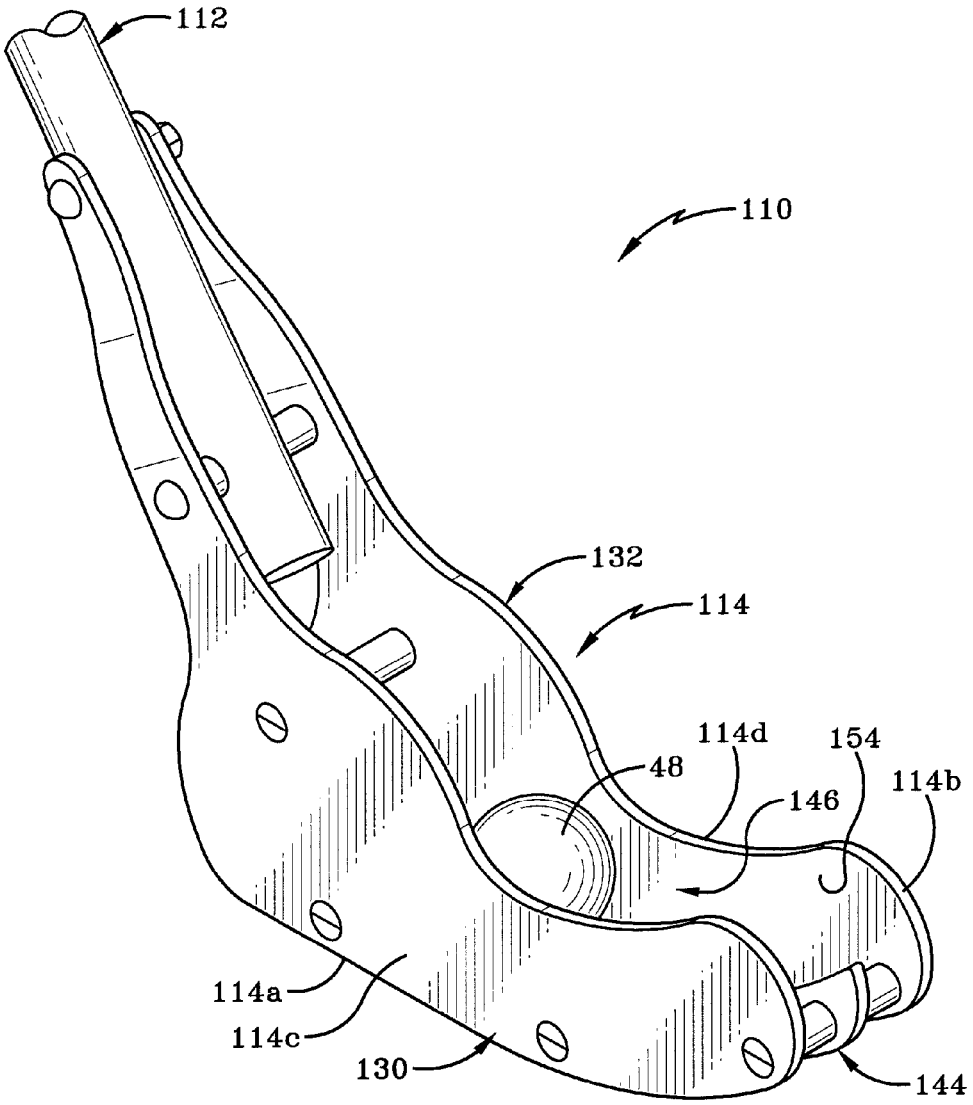
FIG. 15 is a right side perspective view of a third alternate embodiment of the head of the game stick with a ball engaged in the channel.
Figure 16:
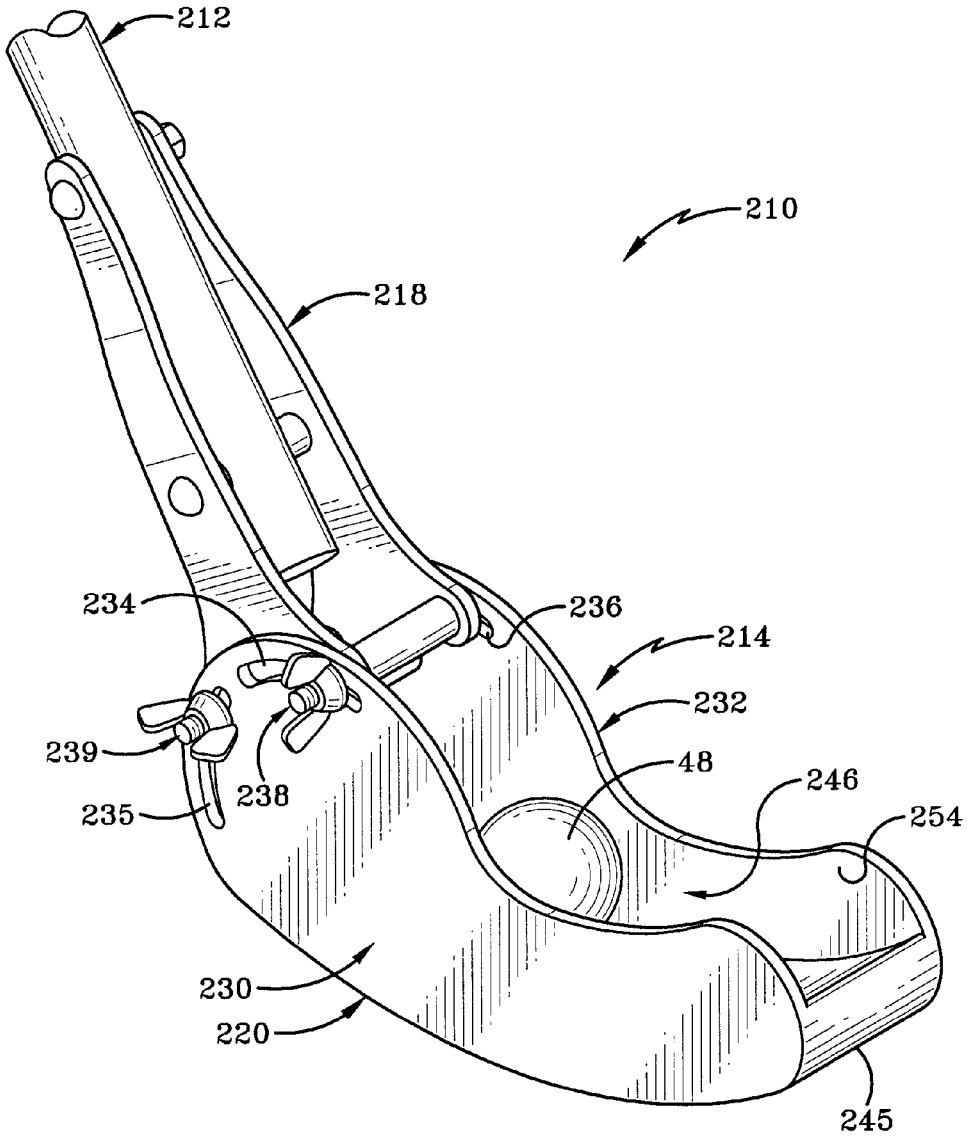
FIG. 16 is a right side perspective view of a fourth embodiment of the head of the game stick with the ball engaged in the channel.

FIG. 15 shows a third embodiment of a head 114 for a game stick which is fabricated from larger plate members 130, 132, 144 that are differently configured to plate members 22, 24, 30, 32, and 44. The larger plate members 130, 132, 144 are directly secured at one end to a shaft 112. T FIG. 16 shows a fourth embodiment of a head 214 for a game stick. Head 214 is fabricated from a combination of plate members (222, 224) and an injection molded component (220). The plate members 222, 224 are secured to the shaft 212 and the injection molded component 220 is secured to the plate members 222, 224. This arrangement allows for adjustment in the orientation of molded component 220 relative to the shaft 212. Although not illustrated herein, it will be understood that the head could be fabricated by integrally forming plate members 222, 224 with the component 220 so that the entire head is injection molded. In this instance, the head would not be adjustable.

Figure 17:
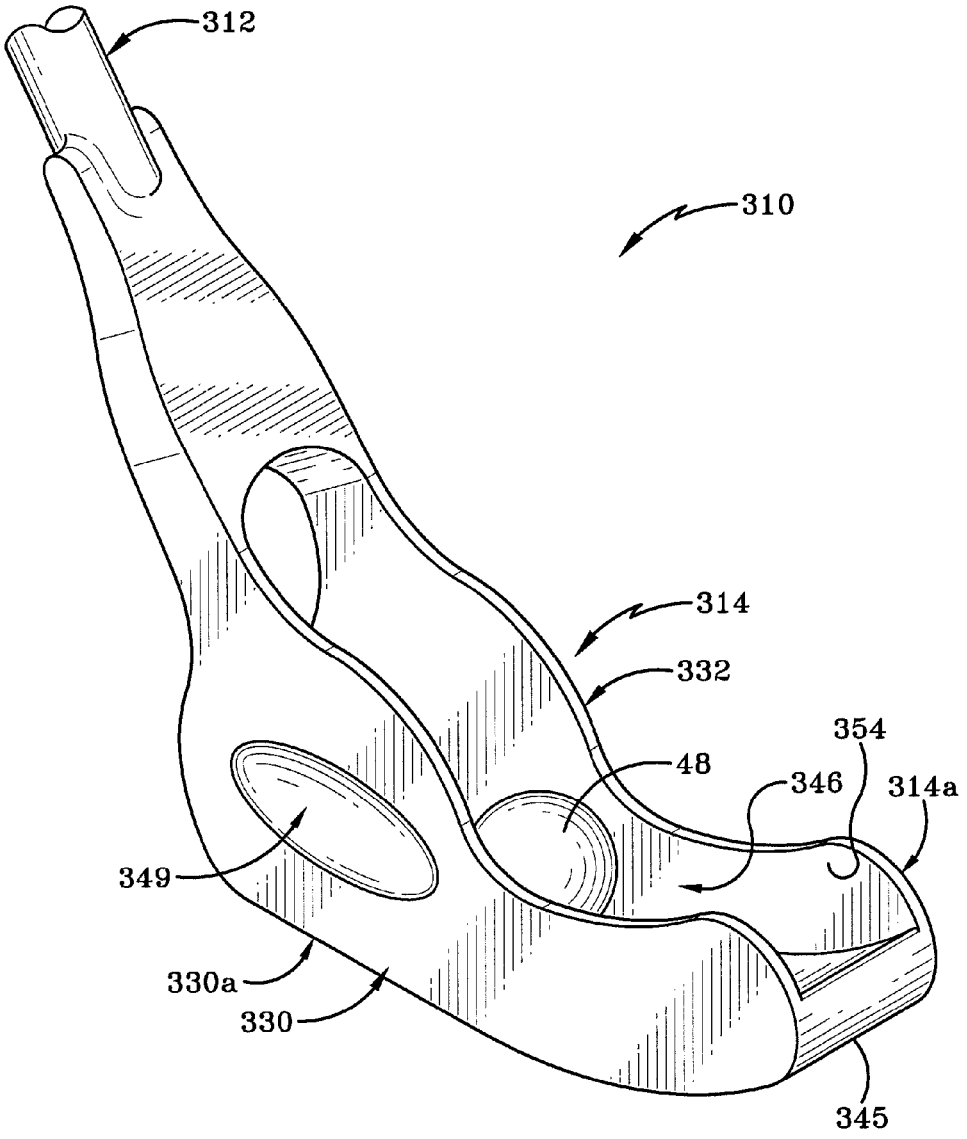
FIG. 17 is a right side perspective view of a fifth embodiment of the head of the game stick showing a depression in the side wall configured to receive a ball therein when the game stick is to be used for throwing the ball a shorter distance. Similar numbers refer to similar parts throughout the drawings.

FIG. 17 shows a fifth embodiment of a head 314 for a game stick in accordance with an aspect of the invention. Head 314 is an injection molded component that is integrally formed with shaft 312 to form a single unit. Head 314 may alternatively be comprised of separate parts that fixedly secured together by heat welding for example. Head 314 includes side walls 330, 332 which define a channel 346 between them. The channel 346 has a substantially continuous bottom wall 345 and a hooked region (not shown) at the end proximate shaft 312. An opening 354 to channel is defined in a front end 314*a* of head 314. Head 314 may be configured with a flattened bottom region so that game stick 310 may be utilized as a putter. In accordance with another aspect, game stick 310 may further define a depression 349 in an exterior surface of one or both sides 330, 332. Depression 349 may be of any suitable configuration to receive game ball 48 therein. As illustrated in FIG. 17, depression 349 is generally elliptical in shape. It may, alternatively, have a raised lip which surrounds the depression or the depression may be formed in a raised region on the side wall of head 314. In use the player will rotate game stick 310 in such a way that side wall 330 is facing upwardly away from the ground upon which the player stands and will set game ball 48 in depression 349. In order to throw ball 48 using game stick 310, the player will rapidly swing game stick 310, rotating the same as he or she does so in such a way that side wall 330 is caused to face the direction in which ball 48 is to be thrown. This combination swinging/rotating motion will cause ball 48 to be thrown from game stick 310. Depression 349 and the afore-mentioned maneuver may be utilized when the distance the ball 48 needs to travel is relatively short, perhaps in the order of 10 to 20 yards. Depression 349 may also optionally be provided with an aperture therein which is in communication with channel 346 as the aperture will more securely anchor ball 48 in depression 349 prior to the throwing action.

Referring again to FIGS. 10-14, head 14 is fabricated in the form of a variety of separate plates. These figures show that head 14 preferably is engaged with second end 12*b* of shaft 12 in such a manner that the orientation of the head 14 relative to shaft 12 may be adjusted. Head 14 includes a first part 18 that is secured to second end 12*b* of shaft 12, and a second part 20 that extends outwardly from first part 18. First part 18 comprises a first plate 22 and a second plate 24. First plate 22 is positioned adjacent a first side of shaft 12 and second plate 24 is positioned adjacent a second side of shaft 12 and opposite first plate 22. First and second plates 22, 24 are substantially identical to each other and thus only first plate 22 will be further described herein. First plate 22 is generally Y-shaped having a narrower stem 22*a* and a body 22*b* which flares outwardly from one end of stem 22*a*. Apertures 22*c* are defined in stem 22*a* and body 22*b* and similarly in plate 24. When first and second plates 22, 24 are positioned adjacent the first and second sides of shaft 12, stem 22*a* is disposed adjacent the side of shaft 12 and body 22*b* extends for a distance beyond the end of shaft 12. Fasteners 26 extend through apertures 22*c* to secure first and second plates 22, 24 to shaft 12 and to each other.

Figure 12:
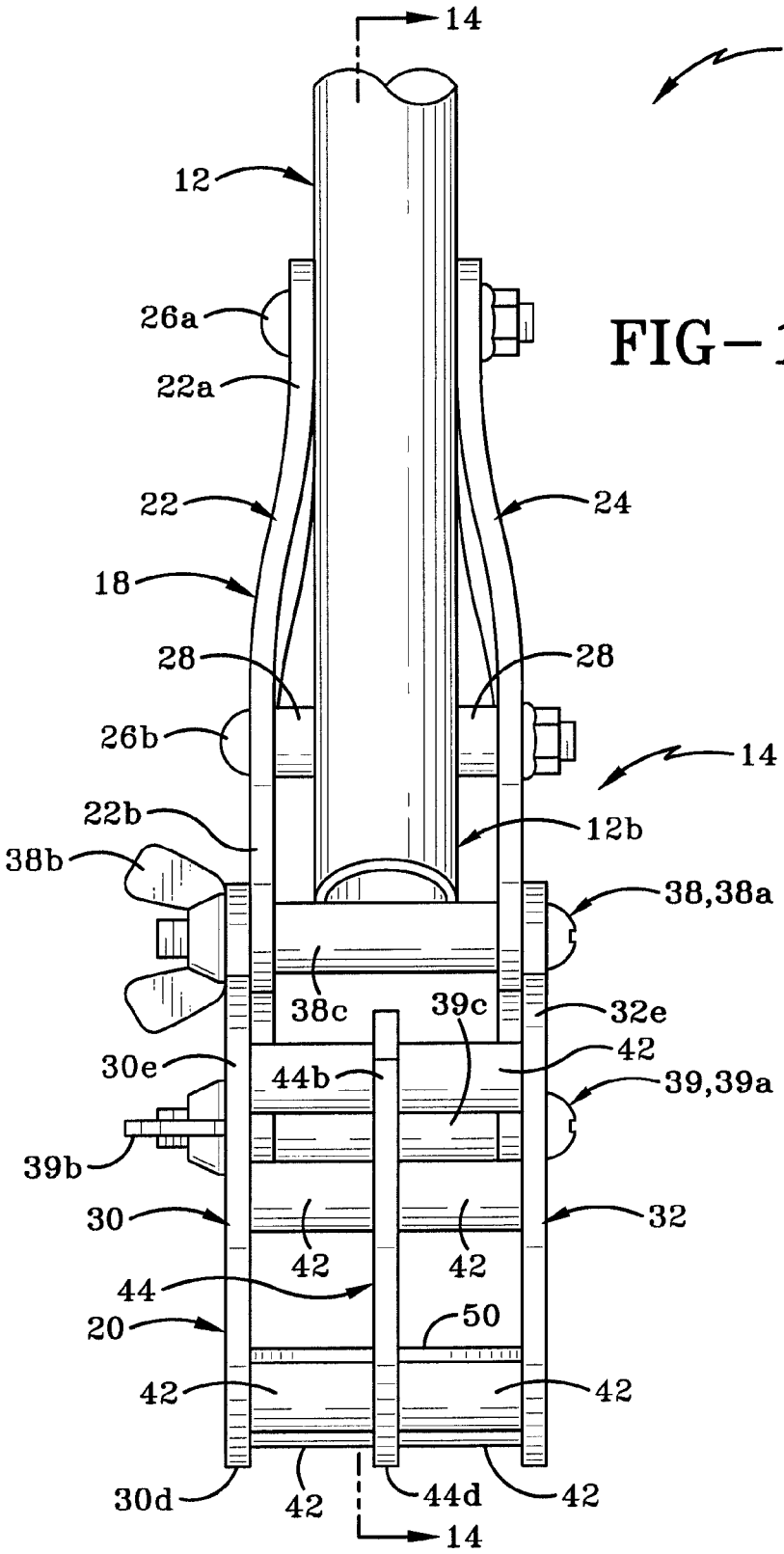
FIG. 12 is a front elevational view of the head shown in FIG. 10.

In accordance with an aspect of the game stick 10 and as shown in FIG. 12, at least a portion body 22*b* and possibly of stem 22*a* are offset relative to the rest of the stem. In other words, the entire length of plate 22 is not aligned along the same plane; some of the regions of the plate 22 are set at an angle to other regions. This offset may be created by engaging differently configured fasteners 26 along the length of stem 22*a* and body 22*b*. As shown in FIG. 12, a first fastener 26*a* is used to secure a first end of stem 22*a* to shaft 12 and a second fastener 26*b* is used to secure a second end of stem 22*a* to shaft 12. First fastener 26*a* is a bolt and nut that draws first and second plates 22, 24 into abutting contact with the sides of shaft 12. Second fastener 26*b* is a bolt and nut but a spacer sleeve 28 is positioned around the bolt's shaft and the ends of this sleeve 28 engage the interior surfaces of plates 22, 24. The interior surfaces of plates 22, 24 are thus kept a distance away from the sides of shaft 12 proximate fastener 26*b* and are thus spaced further away from each other than are the interior surface regions proximate fastener 26*a*. The effect of this configuration is that a spring-type action is imparted to plates 22, 24. This spring action aids in keeping second part 20 of head 14 fully locked to first part 18 thereof. Alternatively, first and second plates 18, 20 may be molded or cast in this offset configuration so that they are spring-loaded plates.

Figure 11:
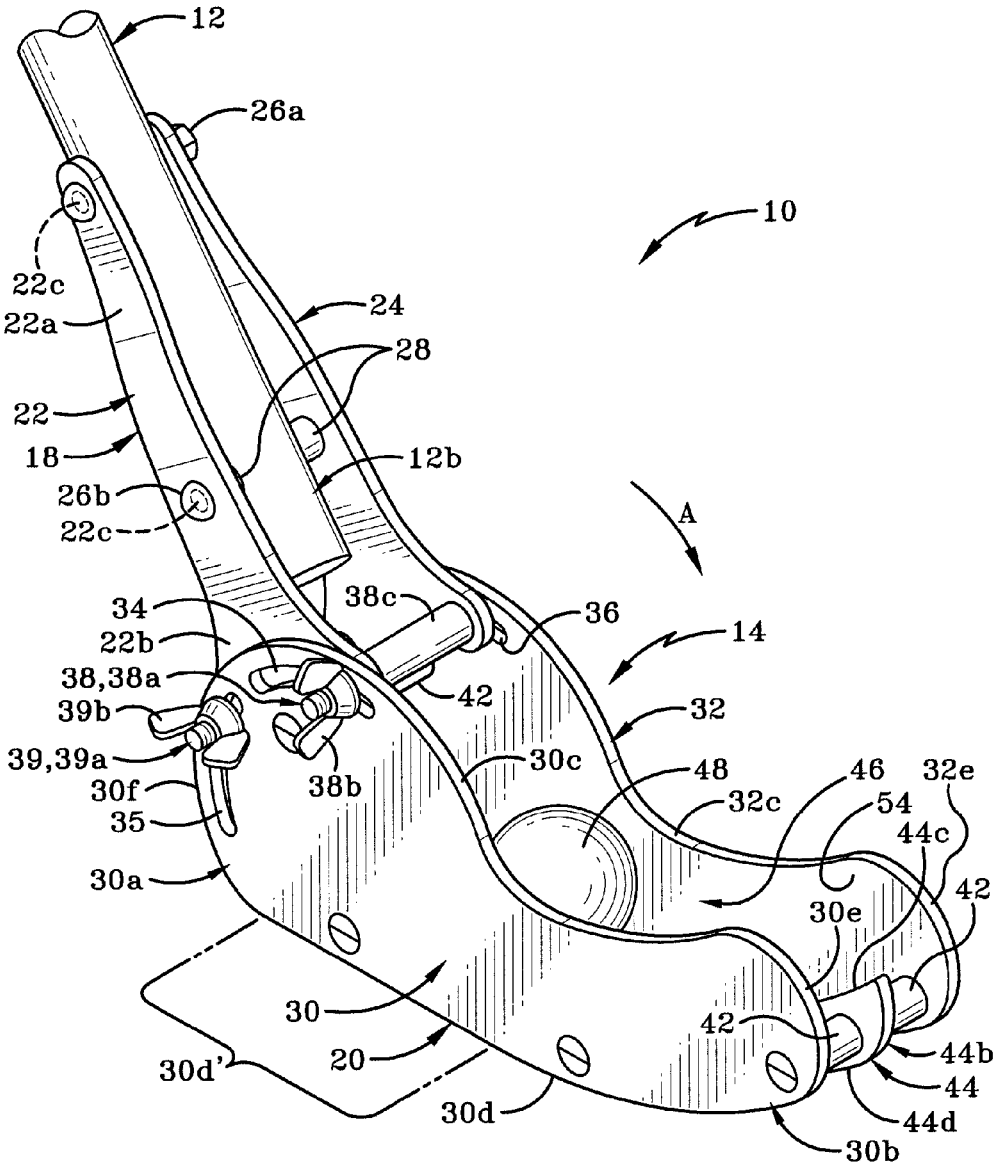
FIG. 11 is a right side perspective view of the head shown in FIG. 10, showing a ball retained in a channel defined therein.

Second part 20 of head 14 may be fabricated in a variety of ways. FIGS. 11 and 12 show second part 20 of head 10 is comprised of two substantially identically-configured planar plates 30, 32. Since plates 30, 32 are substantially identical, only plate 30 will be further described herein. Plate 30 is generally "P-shaped" when viewed from the side; having a generally circular region 30*a* and a generally elongate region 30*b* extending from circular region 30*a*. Plate 30 further includes an upper edge 30*c*, a bottom edge 30*d*, a front edge 30*e*, and a rear edge 30*f*. Upper edge 30*a* is substantially curved along its length from front edge 30*e* to rear edge 30*f*. Bottom edge 30*d* is curved proximate front end 30*e* but preferably is flattened or straight for a distance somewhere along plate 30, such as proximate rear edge 30*f*. This flattened region of bottom edge is indicated at 30*d*' in FIG. 11. The purpose of this flat region 30*d*' will be explained later herein. It should be noted that shaft 12 is substantially longer than head 14. Preferably, bottom edge 30*d* of head 14 is in the order of from about 5 inches up to about 8 inches in length. Shaft 12, on the other hand, preferably is anywhere from about 35 inches long to about 45 inches long. It will be understood that other head lengths and shaft lengths can be utilized without departing from this aspect of the invention.

In accordance with an aspect of the game stick 10, second part 20 is adjustable in orientation relative to first region 18. This allows the player to make adjustments to game stick 10 during play in order to alter the arc of flight or trajectory of the ball 48. Second part 20 is provided with an adjustability assembly to enable this adjustment in orientation to be made. In one aspect, the adjustability assembly is comprised of slots provided in one or both of first region 18 and second part 20 and fasteners that pass through these slots and are operable to slide from one location to another to change the orientation of second part 20; and to be locked at any particular location within the slots to retain a desired orientation.

Figure 13:
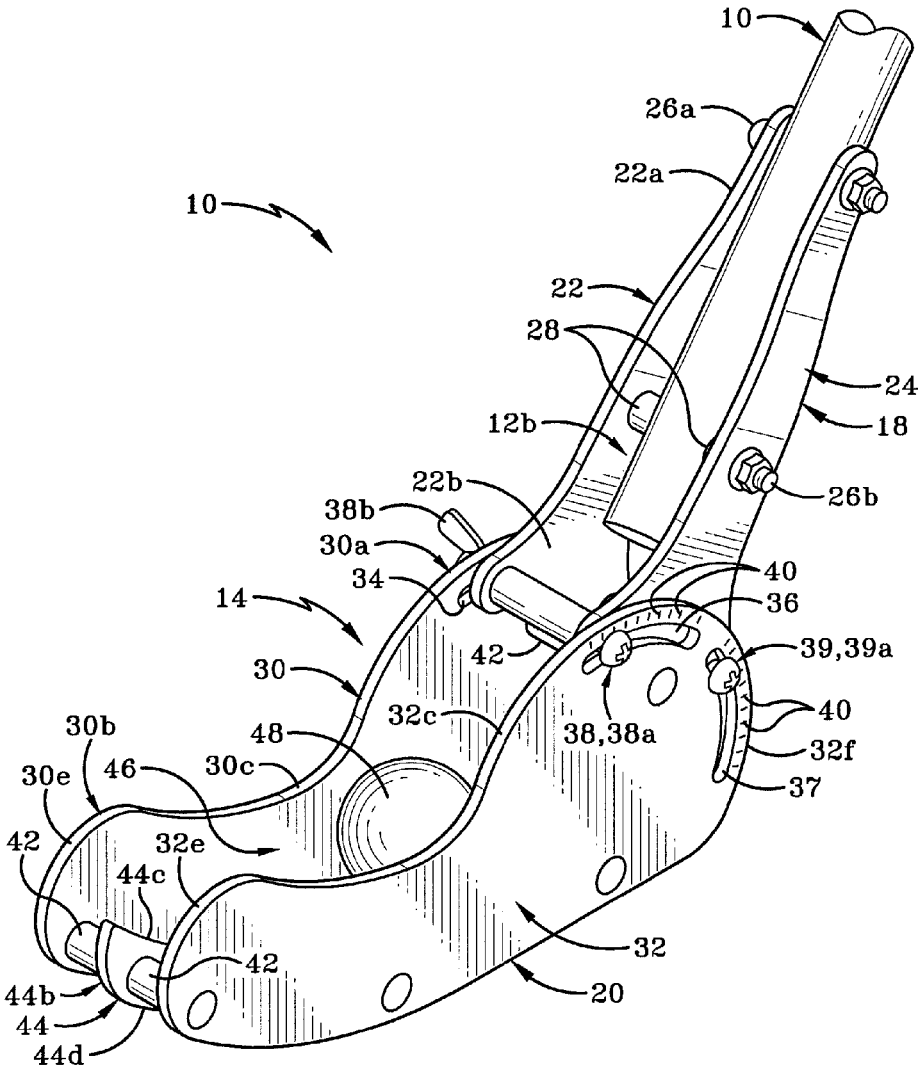
FIG. 13 is a left side perspective view of the head shown in FIG. 10, showing the adjustment slots.

In particular, a first slot 34 and a second slot 35 are defined in plate 30. Similarly, a first slot 36 and a second slot 37 are defined in plate 32 (FIG. 13). First slot 34 is laterally aligned with first slot 36; and second slot 35 is laterally aligned with second slot 37. A first fastener 38 is received through the aligned first slots 34, 36 and a second fastener 39 is received through the aligned second slots 35, 37. First and second fasteners 38, 39 preferably are substantially identical. First fastener 38 thus comprises a bolt 38*a*, a wing nut 38*b* and a spacer sleeve 38*c*. Second fastener 39 comprises a bolt 39*a*, a wing nut 39*b* and a spacer sleeve 39*c*. First plate 22 and second plate 24 of first part 18 each define a pair of spaced apart apertures (not numbered) therein which are alignable with the respect first slots 34, 36 or second slots 35, 37. Bolt 38*a* is passed through the aligned first slots 34, 36, sleeve 38*c*, and one pair of apertures in a front region of plates 22, 24; and bolt 39*a* is passed through the aligned second slots 35, 37, sleeve 39*c*, and the other pair of apertures in a back region of plates 22, 24. Wing nuts 38*b*, 39*b* are engaged with the respective bolts 38*a*, 39*a*. When wing nuts 38*b*, 39*b* are loosely engaged with bolts 38*a*, 39*a*, the bolts can slide along the curved slots 34, 36 or 35, 37. When wing nuts 38*b*, 39*b* are tightly engaged with bolts 38*a*, 39*a*, the bolts are prevented from moving along slots 34, 36 or 35, 37. Sleeves 38*c*, 39*c* are placed around the shaft of their respective bolts 38*a*, 39*a* and act as spacers to retain plate 30 a set distance apart from plate 32. The sleeves 38*c*, 39*c* also provide strength and rigidity to head 14. The provision of this type of adjustment assembly makes it relatively quick and easy for a player to adjust the orientation of second part 20 of head 14 relative to first region 18. Since first region 18 is essentially fixedly secured to shaft by fasteners 26, the adjustment of second part 20 relative to first part 18 automatically changes the relative orientation between second part 20 and shaft 12. This adjustment can be made on the course during the game without requiring any tools. It will, of course, be understood that other suitable adjustment assemblies could be utilized instead of the one shown herein. It is also contemplated that instead of fixedly securing first region 18 to shaft 12 in a particular orientation, some suitable form of adjustment assembly could also be provided to alter the orientation of first region 18 relative to shaft 12. Thus, a two part type of adjustment in orientation of head 14 relative to shaft 12 could be possible in order for a player to optimize how they throw the ball with game stick 10.

It will be understood that while slots 34, 36, 35 and 37 are disclosed as being defined in plates 30, 32 and the apertures (unnumbered) that are alignable therewith for receiving fasteners 38, 39 therethrough are disclosed as being defined in plates 22, 24; it may be desirable in some instances to have the slots defined in the plates 22, 24 of the first part 18 of head 14; and to have the apertures defined in the plates 30, 32 of the second part 20 of head 14. This configuration would still permit the position of the head relative to the shaft to be adjusted.

During play, second part 20 of head 14 may be adjusted relative to first part 18 as follows. As is shown in FIGS. 11 and 13, the rear ends 30*f*, 32*f* of the first and second plates 30, 32 are engaged with base 22*b* of first part 18 of head so that the bottom region of the plates 22, 24 is positioned adjacent the interior surfaces of first and second plates 30, 32. The spring action of plates 22, 24 keeps outward pressure on plates 30, 32, thereby keeping pressure on fasteners 38 and therefore keeping first and second parts 18, 20 of head locked to each other. In order to adjust the position of second part 20 relative to first part 18, wing nuts 38*b*, 39*b* are slightly loosened and the plates 30, 32 are rotated in unison in one of a first direction (indicated by arrow "A") or in a second direction (in the opposite direction to that indicated by arrow "A"). As shown in FIG. 13, plate 32 may additionally be provided with markings or indicia 40 thereon to indicate various angles at which plates 30, 32 may be set relative to shaft 12. Preferably, the indicia or markings 40 show angles of from about 110 degrees through to about 150 degrees. Thus, when fastener 38 is aligned with the indicator marking 40 of 110 degrees, the flattened bottom region 30*d*' of head 14 is close to being generally perpendicular to a longitudinal axis extending along shaft 12 and is thus fairly closed. If the fastener 38 is aligned with the indicator marking 40 for 150 degrees then the bottom region 30*d*' is generally aligned with the longitudinal axis of shaft 12. Thus, when fasteners 38, 39 are aligned with any particular indicia 40, second part 20 of head 14 is set at the angle associated with that indicator 40 relative to shaft 12. When the desired angle is reached, wing nuts 38*b*, 39*b* are tightened to lock plates 30, 32 in the desired orientation.

Preferably, second part 20 further includes a center plate 44 disposed intermediate the interior surfaces of first and second plates 30, 32. Center plate 44 is shorter in height than either of first and second plates 30, 32 and has a first end 44*a*, a second end 44*b*, an upper edge 44*c* and a lower edge 44*d*. Upper edge 44*c* is curved and is generally J-shaped (FIG. 14) along the length of center plate 44, where the length thereof is the distance between first end 44*a* and second end 44*b*. The terminal end of center plate 44 adjacent opening 54 to channel 46 preferably curves slightly upwardly so that a spin is put on the game ball as it exits channel 46 through opening 54. Spacers 42 are disposed at intervals between first and second plates 30, 32 and portions thereof extend through apertures (not numbered) in center plate 44 to plates 30, 32 and 42 in a fixed orientation relative to each other and to assist them to move in unison with each other. Each spacer 42 preferably is of a non-adjustable type. Center plate 44 is curved into a hook shaped region at the first end 44*a* thereof. This hook-shaped region acts as a stop, the purpose of which will be described further herein.

In accordance with another aspect of game stick 10, the interior surfaces of first and second plates 30, 32 and the upper edge 44*c* of center plate 44 define a channel 46 in second part 20 of head 14. Channel 46 is defined in the top surface of second part 20 and preferably is substantially aligned with shaft 12 when game stick 10 is viewed from the side. Channel 46 is accessible from between upper edges 30*c*, 32*c* of first and second plates 30, 32 and extends for substantially the entire length of first and second plates 30, 32 as measured from the hooked-shaped stop at first end 44*a* of center plate 44 to proximate front edges 30*e*, 32*e*, 44*b*. Channel 46 has a width as defined between the interior surfaces of first and second plates 30, 32 and this width is sized to be slightly larger than a game ball 48 that is to be received therein. The width of channel 46 is substantially constant along substantially the entire length of channel 46.

In accordance with an aspect of the game to be played with game stick 10, channel 46 preferably is sized to be slightly wider than the diameter of a standard golf ball. Channel 46 also has a length as measured from a first end 46*a* thereof (proximate shaft 12) to a second end 46*b* thereof (proximate the edge of second part 20 of head 14). Bottom edge 30*d* of head 14 preferably is from about 5 inches in length up to about 8 inches in length. Channel 46 is at least the length of the diameter of a golf ball and preferably is substantially longer than the diameter of a golf ball. The length of channel 46 is selected relative to the overall length of bottom edge 30*d* of head 14. Channel 46 preferably extends from a short distance inwardly rear edge 30*e* to front edge 30*f*. Thus, channel 46 ranges from about 4½ inches in length up to about 7½ inches in length. In accordance with an aspect of game stick 10, channel 46 is defined in the uppermost face of head 14 and terminates in the front face (i.e., in the face defining front edge 30*f* according to the attached figures). It should further be noted that it is not contemplated that a player could catch a game ball in channel 46 or in any other part of head 14. Thus, the width of the channel 46 closely approximates the diameter of the game ball for substantially the entire length of channel 46 and no other part of the head 14 is provided with apertures or nets or any other means by which a ball could be caught. Game stick 10 is configured so that a player will place the game ball in channel 46 by hand.

Figure 14:
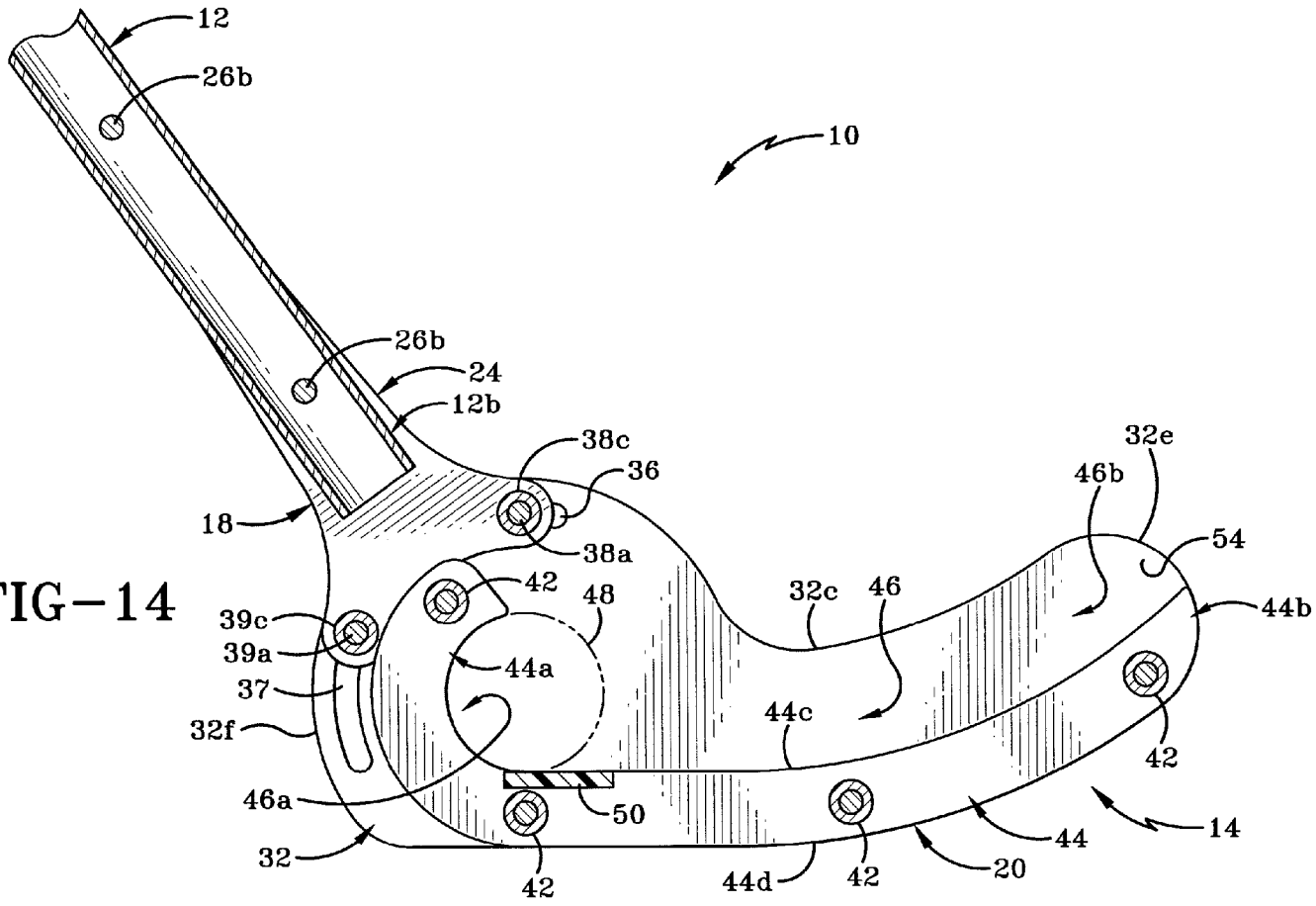
FIG. 14 is a longitudinal cross-section of the head shown in FIG. 10, taken along line 14-14 of FIG. 12.

Channel 46 is curved along its length from a first end 46*a* to a second end 46*b* thereof. A platform 50 preferably is provided on top edge 44*c* of center plate 44, proximate first end 46*a*. Platform 50 provides for initial placement of ball 48 thereon such that ball 48. Platform 50 further acts as a spacer and gives strength and rigidity to second part 20. In accordance with another aspect of game stick 10, and referring to FIG. 14, the curvature of first end 44*a* of center plate 44 preferably is such that game ball 48 will become slightly stuck within the curved interior surface defined by first end 44*a* and between that curved first end 44*a* and platform 50. FIG. 14 illustrates ball 48 stuck in this curved interior surface. This initial retention of ball 48 within first end 44*a* ensures that ball 48 does not fly out of channel 46 as game stick 10 is swung through a first direction to ready the game stick for throwing the ball. It will be understood that other than this curved first end 44*a*, channel 46 preferably is free of all other types of obstructions and retention means along the remainder of its length. Still further, channel 46 preferably is free of obstructions or retaining members proximate the first end 46*a* of channel 46. Ball 48 is able to ride along the curved upper edge 44*c* of center plate 44 as it travels along channel 46 during play of the game, as will be hereinafter described. The movement of ball 48 in a first direction (i.e., toward the first end 46*a* of channel 46) is limited by the stop created by the curved first end 44*a* of center plate 44. Ball 48 is free to travel along the length of channel 46 in a second direction and exit from an opening 54 defined at second end 46*b* of channel 46 between front edges 30*e*, 32*e*. Ball 48 travels along channel 46 by way of centrifugal force as game stick 10 is swung through the air, as will be described further herein. In accordance with yet another aspect of game stick 10, the component parts of head 14 which define channel preferably have surfaces bounding channel 46 that are substantially smooth and free of bumps such that a game ball will roll freely and in a linear fashion along channel 46. Furthermore, the surfaces along which the game ball will roll preferably are free of any depressions or holes which might cause the ball's movement to be arrested or for the ball to become seated therein during movement between first and second ends 46*a*, 46*b*.

Center plate 44 may be replaced with a substantially continuous wall that extends between the interior surfaces of first and second plates 30, 32. In this instance, there will be no need for spacers 42 and the substantially continuous wall will preferably be fixedly secured to plates 30, 32. Thus, channel 46 will be generally U-shaped in cross-section. It is alternatively contemplated that an upper wall (not shown) could also be spaced between the interior surfaces of first and second plates 30, 32 and disposed opposite a substantially continuous bottom wall. Then upper wall would require an aperture to be defined therein and into which the game ball 48 could be placed. When the game stick including these features is swung, the game ball 48 will travel through essentially what constitutes a chute in the head 14 and exit the head through an opening 54 defined between front edges 30*e*, 32*e*.

It is also contemplated that some type of friction altering material could be applied to the surfaces that define channel 46 in whatever format it takes. The friction-altering materials could be materials that allow the ball 48 to slide more easily of the surfaces defining channel 46; or they may be material that impede the travel of ball 48 slightly so that game stick 10 has to be swung more vigorously to release ball 48 at speed.

The first and second parts 18, 20 of head 20 preferably are fabricated from a suitable rigid plastic material that is both strong and light weight. Other suitable materials for use could be materials such as titanium, for example. Although not illustrated herein it will be understood that one or both of first and second parts 18, 20 of head 14 may include one or more cut-outs or apertures defined between the interior and exterior surfaces of plates 22, 24, 30, 32 to decrease the overall weight of head 14. These cut-outs would also permit airflow to aid in moving ball along channel 46.

The new game is played with game stick 10 in much the same manner as described with reference to game stick 410. However, the method of play may further include steps for adjusting the orientation of head 14 of game stick 10 relative to shaft 12 thereof. This adjustment is accomplished by loosening a first fastener 38 which secures a first part 18 of head 14 to a second part 20 thereof; sliding first fastener 38 along a pair of aligned first slots 34, 36 defined in one of the first and second parts 18, 20 of head 14 from a first position to a second position; and tightening first fastener 38 when in the second position.

The method further comprises the step of aligning first fastener 38 with a marking 40 provided on a region of the head 14 adjacent at least one of the first slots 34, 36. The method may further include the step of loosening a second fastener 39 which secures first and second parts 18, 20 of head 14 together by sliding second fastener 39 along a pair of aligned second slots 35, 37 defined in one of the first and second parts 18, 20 of head from a first position to a second position simultaneously with the sliding of the first fastener 38 along the pair of first slots 34, 36; tightening the second fastener 39 in place at the second position thereof.

FIG. 15 shows the third embodiment of a game stick for the new game, generally indicated at 110. Game stick 110 includes a shaft 112 and a head 114. Shaft 112 is substantially identical to shaft 12. Head 114, on the other hand, does not include separate first and second parts similarly to parts 18, 20. Instead, each plate 130, 132 is a single integral piece that is generally L-shaped when viewed from the side. An upper region of each L-shaped plate 130, 132 is secured by fasteners to shaft 112. Head 114 is not adjustably engaged with shaft 112 but is instead rigidly engaged therewith. A channel 146 is defined in upper region of head 114 and a center plate 144 similar to plate 44 is secured between plates 130, 132 and defines an opening 154 at one end thereof. As with the first embodiment, channel 146 is curved along its length and is configured to closely approximate the diameter of a game ball 48 therein. Because head 114 is not adjustable relative to shaft 112, channel 146 is always disposed at a set orientation relative to shaft 112. Head 114 has a bottom edge 114*a* at least a portion of which is flattened and side wall 114*c* is substantially planar so that head 114 may be used as a putter. The flattened region of bottom edge 114*a* is preferably disposed a distance rearwardly of front end 114*b* of side wall 114. Alternatively, instead of being useful as a putting surface, exterior surface of side wall 114*c* or the exterior surface of the opposing side wall 114*d* can be used as a hitting surface. Thus, the player can toss the game ball 48 in the air and then strike the ball on the exterior surface of either of the side walls 114*c*, 114*d*. Alternatively, although not shown herein, one or both of side walls 114*c* and 114*d* may include angular regions that are configured in much the same way as the faces of a golf club that is used to play chip-shots. In this instance those angular regions can be used to play chip-shots during play of the game disclosed herein. Although not illustrated herein, it will be understood that head 114 may also be provided with one or more cut-outs to decrease the overall weight of head 114. It will be understood that game stick 110 is used to play the new game in the manner described with reference to game stick 410.

FIG. 16 shows the fourth embodiment of a game stick for the new game, generally indicated at 210. Game stick 210 includes a shaft 212 that is substantially identical to shaft 12 or shaft 112. Game stick 210 further includes a head 214 that has a first part 218 and a second part 220. First part 218 comprises a pair of plates similar to plates 18. Second part 220, on the other hand, comprises a single, integral injection-molded component. Second part 220 includes sides 230 and 232 which are spaced apart from each other and which define a channel 246 between them. A wall 245 extends between sides 230, 232 and forms the bottom of the channel 246. Sides 230, 232 of head 214 define a pair of first slots 234, 236 therein as well a second slot 235 in side 230 and an opposed and aligned slot (not shown) in side 232. As with the first embodiment, adjustable fasteners 238, 239 secure first part 218 to second part 220. Fasteners 238, 239 are able to be loosened to adjust the angle of second part 220 relative to first region 218 and thereby to shaft 212. Fasteners 238, 239 are then tightened to lock head 214 in the desired angle relative to shaft 212. As with the first embodiment, markings (not shown) may be provided adjacent any or all of the slots 234, 235, 236 and the slot that isn't shown, so that a particular angle for the second part 220 is able to be selected by the player. Channel 246 is sized to receive a game ball 48 therein. This embodiment of game stick 210 is not illustrate as including a putting edge or chipping surface but is adjustable relative to shaft. First part 218 may be adjustably engaged with shaft 212 in much the same way as first part 18 may be adjustably engaged with shaft 12. Because wall 245 is provided, there is no need for a platform similar to platform 50 to be provided. Wall 245 will be configured to be have a similar cross-sectional profile to center plate 44 and therefore preferably include a hooked region or rear wall (not shown) that will limit the travel of ball 48 back toward shaft 212. An opening 254 to channel 246 is defined adjacent the front end of head 214. It will be understood that game stick 210 is used to play the new game in the manner described with reference to game stick 410.

FIG. 17 shows the fifth embodiment of a game stick, generally indicated at 310. In this embodiment the shaft 312 and head 314 are an integral single unit that is injection molded or comprises components parts that are fixedly secured together by heat welding for example. Head 314 includes side walls 330, 332 which define a channel 346 between them. The channel 346 has a substantially continuous bottom wall 345 and a hooked region (not shown) at the end proximate shaft 312. An opening 354 to channel is defined in a front end 314*a* of head 314. Head 314 may be configured with a flattened bottom region so that game stick 310 may be utilized as a putter. In accordance with another aspect, game stick 310 may further define a depression 349 in an exterior surface of one or both sides 330, 332. Depression 349 may be of any suitable configuration to receive game ball 48 therein. As illustrated in FIG. 17, depression 349 is generally elliptical in shape. It may, alternatively, have a raised lip which surrounds the depression or the depression may be formed in a raised region on the side wall of head 14. In use the player will rotate game stick 310 in such a way that side wall 330 is facing upwardly away from the ground upon which the player stands and will set game ball 48 in depression 349. In order to throw ball 48 using game stick 310, the player will rapidly swing game stick 310, rotating the same as he or she does so in such a way that side wall 330 is caused to face the direction in which ball 48 is to be thrown. This combination swinging/rotating motion will cause ball 48 to be thrown from game stick 310. This depression 349 and maneuver may be utilized when the distance the ball 48 needs to travel is relatively short, perhaps in the order of 10 to 20 yards. Depression 349 may also optionally be provided with an aperture therein which is in communication with channel 346 as the aperture will more securely anchor ball 48 in depression 349 prior to the throwing action. It will be understood that game stick 310 is used to play the new game in the manner described with reference to game stick 410. However, the player may additionally turn the shaft so side wall 330 faces upwardly. The player will then position ball 48 in depression 349 in side wall 330 and will gently swing game stick 310 in a first direction to ready game stick 310 for the throw. The player will then swing game stick 310 in a second direction in a more vigorous fashion in order to throw the ball a shorter distance than if ball 48 was located in channel 346.

It will be understood that because the heads 414, 14, 114, and 214 are secured to the associated shaft with some type of fastener, the player could have a plurality of differently configured heads and swap them during the course of a game for different conditions and throws that have to be made. Similarly, the player could have a plurality of different shafts that are longer or shorter; or more or less flexible; or made out different materials that are lighter or heavier, for example, and then could combine any of the shafts with any of the heads to custom make his or her game stick for the particular course or hole or play he or she wishes to make.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the aspects of the invention are an example and the invention is not limited to the exact details shown or described.

The invention claimed is:

1. A game stick for use with a golf ball, said stick comprising:

a shaft having a first end, a second end and a longitudinal axis;

a rigid head provided at the second end of the shaft;

the head having a neck with a bore, the second end of the shaft extending into the bore, the head further having a back wall, a first side wall having a top edge, a second side wall having a top edge, a first front edge, a second front edge and a bottom wall, wherein interior surfaces of the back wall, first side wall, second side wall and bottom wall define a channel adapted to receive the golf ball and from which the golf ball is thrown during play, the back wall being at one end of the channel and the first and second front edges being at an opposing end of the channel, and wherein the first and second side walls define a gap along the channel larger than the diameter of the golf ball, the gap sized and positioned to permit the golf ball to freely travel along the channel; and the first side wall comprising a first arcuate surface defining a first void positioned proximal to the back wall and the second side wall comprising a second arcuate surface defining a second void positioned opposite the first void, each of the first and second arcuate surfaces being sized and positioned to independently cradle the golf ball and inhibit movement of the golf ball when the golf ball is seated against the back wall and the head is tilted toward the side wall having the void, and the gap between the side walls defining a gap between the arcuate surfaces larger than the diameter of the golf ball, wherein the first front edge is directly adjacent to and disposed at an obtuse angle relative to the top edge of the first side wall and the second front edge is directly adjacent to and disposed at an obtuse angle relative to the top edge of the second side wall and wherein the bottom wall is disposed at an angle (S) from 105 degrees to about 165 degrees relative to the longitudinal axis of the shaft.

2. The game stick as defined in claim 1, wherein the back wall has an interior surface defining a back wall radius that matches a golf ball radius defined by the golf ball, whereby the golf ball fits within the interior surface when the golf ball is positioned at the end of the channel adjacent the shaft.

3. The game stick as defined in claim 1, wherein the side walls are substantially parallel to each other.

4. The game stick as defined in claim 1, wherein the channel is defined by substantially smooth surfaces.

5. The game stick of claim 1, wherein the channel is between 2 and 6 inches long.

6. The game stick of claim 1, wherein the channel is between 42 and 50 millimeters in width.

7. The game stick of claim 1, wherein the side walls are at least 22 millimeters tall.

8. The game stick of claim 1, wherein the side walls are between 20 millimeters and 70 millimeters tall.

9. The game stick of claim 1, wherein the first void defines a first round aperture, and wherein the second void defines a second round aperture, a diameter of each of the first and second apertures being less than a diameter of the golf ball.

10. The game stick of claim 1, wherein the side walls are substantially parallel to each other.

11. The game stick of claim 1, wherein an exterior surface of at least one of the side walls includes a pushing surface comprising a concavity having a partial cylinder shape extending upwardly on the first side wall, the partial cylinder shape having a U-shaped cross-section when viewed down a height of the partial cylinder shape, and wherein the concavity has a radius of at least 21.3 millimeters, for pushing the golf ball resting on a ground surface when the shaft axis is at an angle of between 65 and 90 degrees to the ground surface.

12. The game stick of claim 1, wherein the head includes a plurality of apertures for reducing the weight of the head.

13. The game stick of claim 1, wherein:

the angle (S) is about 108° relative to the longitudinal axis of the shaft.

14. The game stick of claim 1, wherein the first side wall has an exterior surface opposite the interior surface of the first side wall, and the exterior surface includes two edge portions flanking a recessed surface, the two edge portions extending upwardly on the first side wall and the recessed surface being sized to receive the golf ball.

15. A game stick for use with a golf ball, said stick comprising:

a shaft having a first end, a second end and a longitudinal axis;

a rigid head provided at the second end of the shaft;

the head having a neck with a bore, the second end of the shaft extending into the bore, the head further having a back wall, a first side wall having a top edge, a second side wall having a top edge, a first front edge, a second front edge and a bottom wall, wherein interior surfaces of the back wall, first side wall, second side wall and bottom wall define a channel adapted to receive the golf ball and from which the golf ball is thrown during play, the back wall being at one end of the channel and the first and second front edges being at an opposing end of the channel, and wherein the first and second side walls define a gap along the channel larger than the diameter of the golf ball, the gap sized and positioned to permit the golf ball to freely travel along the channel; and the first side wall comprising a first arcuate surface defining a first void positioned proximal to the back wall and the second side wall comprising a second arcuate surface defining a second void positioned opposite the first void, each of the first and second arcuate surfaces being sized and positioned to independently cradle the golf ball and inhibit movement of the golf ball when the golf ball is seated against the back wall and the head is tilted toward the side wall having the void, and the gap between the side walls defining a gap between the arcuate surfaces larger than the diameter of the golf ball; and an exterior surface of the first side wall including a pushing surface positioned between the first void and the first front edge, the pushing surfacing comprising a concavity having a partial cylinder shape extending upwardly on the first side wall, the partial cylinder shape having a U-shaped cross-section when viewed down a height of the partial cylinder shape wherein the first front edge is directly adjacent to and disposed at an obtuse angle relative to the top edge of the first side wall and the second front edge is directly adjacent to and disposed at an obtuse angle relative to the top edge of the second side wall.

16. The game stick of claim 15, wherein the first void defines a first round aperture, and wherein the second void defines a second round aperture.

* * * * *